US012745820B2

(12) United States Patent
Fauconnier et al.

(10) Patent No.: US 12,745,820 B2
(45) Date of Patent: Sep. 29, 2026

(54) ARTICLE OF FOOTWEAR HAVING EXCHANGEABLE PODS

(71) Applicant: PUMA SE, Herzogenaurach (DE)

(72) Inventors: Sidney Fauconnier, Nuremberg (DE); Mauro Bonin, Nuremberg (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 18/507,848

(22) Filed: Nov. 13, 2023

(65) Prior Publication Data

US 2024/0156207 A1 May 16, 2024

Related U.S. Application Data

(60) Provisional application No. 63/425,208, filed on Nov. 14, 2022.

(51) Int. Cl.

| | |
|---|---|
| ***A43B 7/1463*** | (2022.01) |
| ***A43B 13/18*** | (2006.01) |
| ***A43B 13/36*** | (2006.01) |

(52) U.S. Cl.

CPC ..... *A43B 7/1463* (2022.01); *A43B 13/181* (2013.01); *A43B 13/188* (2013.01); *A43B 13/36* (2013.01)

(58) Field of Classification Search

CPC ..... A43B 13/181; A43B 13/86; A43B 13/188; A43B 13/125; A43B 13/36; A43B 7/1463; A43B 7/1464; A43B 7/1466; A43B 7/1467; A43B 7/1468; A43B 7/1469

See application file for complete search history.

(56) References Cited

U.S. PATENT DOCUMENTS

| | | | | |
|---|---|---|---|---|
| 2,983,056 A | | 5/1961 | Murawski | |
| 3,469,576 A | | 9/1969 | Smith | |
| 3,573,155 A | | 3/1971 | Mitchell | |
| 3,629,051 A | | 12/1971 | Mitchell | |
| 3,810,318 A | * | 5/1974 | Epstein | A43B 7/143 36/105 |
| 4,100,686 A | | 7/1978 | Sgarlato et al. | |
| 4,112,599 A | | 9/1978 | Krippelz | |

(Continued)

FOREIGN PATENT DOCUMENTS

| | | |
|---|---|---|
| AT | 1378549 T | 4/2021 |
| AT | 1486244 T | 5/2022 |

(Continued)

OTHER PUBLICATIONS

US D748,382 S, 02/2016, Galway et al. (withdrawn)

(Continued)

*Primary Examiner* — Heather Mangine

(74) *Attorney, Agent, or Firm* — Quarles & Brady, LLP

(57) ABSTRACT

An article of footwear includes an upper attached to a stabilizer, an outsole, a first pod, and a second pod. The stabilizer has a lower surface and a first securing mechanism. The outsole has a first retention mechanism and an interior surface. The first securing mechanism is retained by the first retention mechanism. A volume between the lower surface and the interior surface forms a midsole cavity. The midsole cavity receives the first pod and the second pod.

22 Claims, 14 Drawing Sheets

(56) References Cited

U.S. PATENT DOCUMENTS

D256,067 S 7/1980 Hagg et al.
4,235,026 A 11/1980 Plagenhoef
4,279,083 A * 7/1981 Dilg ..... A43B 1/0081 36/101
D265,017 S 6/1982 Vermonet
D272,963 S 3/1984 Muller et al.
4,779,359 A 10/1988 Famolare, Jr.
D298,582 S 11/1988 Caire
D304,520 S 11/1989 Clark
4,918,838 A * 4/1990 Chang ..... A43B 13/203 36/28
D307,971 S 5/1990 Maccano et al.
4,942,679 A 7/1990 Brandon et al.
4,944,099 A 7/1990 Davis
D311,989 S 11/1990 Parker et al.
5,042,176 A 8/1991 Rudy
5,084,987 A 2/1992 Flemming
D324,762 S 3/1992 Hatfield
5,134,790 A 8/1992 Woitschaetzke et al.
D329,528 S 9/1992 Hatfield
5,152,081 A 10/1992 Hallenbeck et al.
D330,629 S 11/1992 Bramani
5,197,206 A 3/1993 Shorten
5,197,207 A 3/1993 Shorten
D337,650 S 7/1993 Thomas, III et al.
D340,797 S 11/1993 Pallera et al.
5,313,717 A 5/1994 Allen et al.
5,329,705 A 7/1994 Grim et al.
D350,222 S 9/1994 Hase
5,378,223 A 1/1995 Grim et al.
5,383,290 A 1/1995 Grim
D356,438 S 3/1995 Opie et al.
D365,920 S 1/1996 Schneider
5,607,749 A 3/1997 Strumor
D386,589 S 11/1997 Cass
D389,991 S 2/1998 Elliott
D390,349 S 2/1998 Murai et al.
5,743,028 A * 4/1998 Lombardino ..... A43B 21/28 36/38
5,799,417 A * 9/1998 Burke ..... A43B 3/0047 36/105
5,952,065 A 9/1999 Mitchell et al.
D414,920 S 10/1999 Cahill
D415,610 S 10/1999 Cahill
D415,876 S 11/1999 Cahill
5,979,078 A 11/1999 McLaughlin
D423,199 S 4/2000 Cahill
D429,874 S 8/2000 Gumbert
D431,346 S 10/2000 Birkenstock
D444,620 S 7/2001 Della Valle
D446,002 S 8/2001 Leong et al.
D460,852 S 7/2002 Daudier
6,457,263 B1 10/2002 Rudy
6,467,197 B1 10/2002 Mitsui et al.
6,558,784 B1 5/2003 Norton et al.
6,618,959 B1 9/2003 Sussmann
6,647,646 B2 11/2003 Mitsui et al.
D483,932 S 12/2003 Cooper
6,665,958 B2 12/2003 Goodwin
6,670,029 B2 12/2003 Norton et al.
6,763,615 B2 7/2004 Mitsui et al.
D494,343 S 8/2004 Morris
6,782,640 B2 8/2004 Westin
D496,149 S 9/2004 Belley et al.
6,817,113 B2 11/2004 Pan
6,848,200 B1 2/2005 Westin
6,883,252 B2 4/2005 Cagner
6,920,707 B1 7/2005 Greene et al.
6,944,973 B2 9/2005 Goodwin
6,951,066 B2 10/2005 Snow
6,957,504 B2 10/2005 Morris
D512,208 S 12/2005 Kubo et al.
D515,297 S 2/2006 Acheson
7,086,179 B2 8/2006 Dojan et al.
7,086,180 B2 8/2006 Dojan et al.
7,096,605 B1 8/2006 Kozo et al.
7,100,310 B2 9/2006 Foxen et al.
7,141,131 B2 11/2006 Foxen et al.
7,153,560 B2 12/2006 Hofmann
7,181,866 B2 2/2007 Braunschweiler
7,200,955 B2 4/2007 Foxen
7,254,906 B2 8/2007 Morris et al.
D549,934 S 9/2007 Horne et al.
D551,831 S 10/2007 Romero-Sanchez
D556,982 S 12/2007 Harper et al.
D560,883 S 2/2008 McClaskie
D561,433 S 2/2008 McClaskie
D571,085 S 6/2008 McClaskie
7,401,420 B2 7/2008 Dojan et al.
D576,780 S 9/2008 Jolicoeur
D586,090 S 2/2009 Turner et al.
7,484,318 B2 2/2009 Finkelstein
D596,384 S 7/2009 Andersen et al.
7,555,848 B2 7/2009 Aveni et al.
7,556,846 B2 7/2009 Dojan et al.
7,559,107 B2 7/2009 Dojan et al.
7,562,469 B2 7/2009 Dojan
D597,293 S 8/2009 Banik et al.
D601,333 S 10/2009 McClaskie
7,665,230 B2 2/2010 Dojan et al.
7,676,955 B2 3/2010 Dojan et al.
7,676,956 B2 3/2010 Dojan et al.
7,685,741 B2 3/2010 Friedman
7,694,437 B2 4/2010 Hogan
7,694,438 B1 4/2010 Christensen et al.
D616,183 S 5/2010 Skaja
D617,540 S 6/2010 McClaskie
D624,291 S 9/2010 Henderson
7,805,859 B2 10/2010 Finkelstein
D631,237 S 1/2011 Genuin et al.
D631,646 S 2/2011 Muller
D633,286 S 3/2011 Skaja
D633,287 S 3/2011 Skaja
D636,571 S 4/2011 Avar
8,074,377 B2 12/2011 Nishiwaki et al.
8,112,909 B2 2/2012 Kubo et al.
8,122,614 B2 2/2012 Sussmann
8,151,485 B2 4/2012 Hurd et al.
8,176,657 B2 5/2012 Schinlder et al.
8,178,022 B2 5/2012 Schindler et al.
8,241,450 B2 8/2012 Hensley et al.
8,256,141 B2 9/2012 Christensen et al.
8,266,826 B2 9/2012 Cassiday et al.
8,296,969 B2 10/2012 Granger et al.
D671,305 S 11/2012 Escobar
D671,306 S 11/2012 Tzenos
8,312,644 B2 11/2012 Peikert et al.
8,321,984 B2 12/2012 Dojan et al.
8,356,429 B2 1/2013 Eder et al.
8,418,379 B2 4/2013 Nishiwaki et al.
8,429,835 B2 4/2013 Dojan et al.
8,453,344 B2 6/2013 Nishiwaki et al.
8,479,412 B2 7/2013 Peyton et al.
8,490,296 B2 7/2013 Hurd et al.
D693,553 S 11/2013 McClaskie
8,572,866 B2 11/2013 Dojan et al.
8,578,535 B2 11/2013 Dojan et al.
D696,501 S 12/2013 Miner
D696,502 S 12/2013 Miner
D696,503 S 12/2013 Miner
8,657,979 B2 2/2014 Dojan et al.
8,671,591 B2 3/2014 Brown
8,745,892 B2 6/2014 Polegato Moretti
D709,680 S 7/2014 Herath
8,782,924 B2 7/2014 Peyton et al.
8,789,298 B2 7/2014 Eder et al.
D711,081 S 8/2014 Miner
D713,623 S 9/2014 Lo
8,863,408 B2 10/2014 Schindler et al.
8,919,013 B2 12/2014 Christensen et al.
8,943,709 B2 2/2015 Aveni et al.
8,961,844 B2 2/2015 Baghdadi et al.
8,978,272 B2 3/2015 Hurd et al.
8,978,273 B2 3/2015 Cook et al.

(56) References Cited

U.S. PATENT DOCUMENTS

D731,763 S 6/2015 Solstad
9,066,556 B2 6/2015 Peyton et al.
9,066,557 B2 6/2015 Peyton et al.
D734,600 S 7/2015 Gargiulo
9,078,493 B2 7/2015 Bradford
D739,131 S 9/2015 Del Biondi
9,125,454 B2 9/2015 De Roode et al.
9,144,266 B2 9/2015 Christensen et al.
D740,003 S 10/2015 Herath
D740,004 S 10/2015 Hoellmueller et al.
9,179,733 B2 11/2015 Peyton et al.
D746,559 S 1/2016 Besanceney et al.
9,241,536 B2 1/2016 Smaldone et al.
9,265,302 B2 2/2016 Peyton et al.
9,271,544 B2 3/2016 Peyton et al.
9,289,030 B2 * 3/2016 Peyton ..... A43B 13/18
D753,381 S 4/2016 Ostapenko
9,320,317 B2 4/2016 Bernhard et al.
D756,085 S 5/2016 Spring
D756,620 S 5/2016 Boys
9,326,564 B2 5/2016 Peyton et al.
9,351,534 B2 5/2016 Peikert et al.
D758,056 S 6/2016 Galway et al.
D759,358 S 6/2016 Cullen
9,402,439 B2 8/2016 Cross et al.
9,420,848 B2 8/2016 Campos et al.
D765,361 S 9/2016 Johnsongriffin
D765,362 S 9/2016 Kuerbis
D767,263 S 9/2016 Reiser
9,445,646 B2 9/2016 Cook et al.
9,456,656 B2 10/2016 Cross
9,456,658 B2 10/2016 Bruce et al.
9,486,036 B1 11/2016 Douglas
9,486,037 B2 11/2016 Cook et al.
D773,161 S 12/2016 Teteriatnikov
D773,790 S 12/2016 Raysse
D773,791 S 12/2016 Raysse
9,510,640 B2 12/2016 Bier et al.
9,516,919 B2 12/2016 Ernst et al.
9,521,877 B2 12/2016 Campos et al.
D776,410 S 1/2017 Galway et al.
9,538,811 B2 1/2017 Cross
9,549,590 B2 1/2017 Cross et al.
9,554,620 B2 1/2017 Cross et al.
9,554,622 B2 1/2017 Cross
9,554,624 B2 1/2017 Cross
9,572,404 B2 2/2017 Dojan et al.
D781,543 S 3/2017 Raysse
9,585,435 B2 3/2017 Bier et al.
D783,247 S 4/2017 McMillan
9,610,746 B2 4/2017 Wardlaw et al.
9,629,414 B2 4/2017 Elder et al.
9,682,522 B2 6/2017 Baghdadi et al.
9,687,041 B2 6/2017 Peikert et al.
D790,817 S 7/2017 Perkins et al.
D791,452 S 7/2017 Dombrow
D792,067 S 7/2017 Raysse
D793,680 S 8/2017 Lee
D793,688 S 8/2017 Avar et al.
D794,289 S 8/2017 Kanata
9,717,301 B2 8/2017 Peikert et al.
9,717,304 B2 8/2017 Bernhard et al.
9,723,895 B2 8/2017 Schaefer et al.
D797,418 S 9/2017 Lee et al.
9,750,307 B2 9/2017 Campos et al.
D798,553 S 10/2017 Lee
D799,183 S 10/2017 Weeks
9,775,403 B2 10/2017 Bernhard et al.
9,775,769 B2 10/2017 Brown et al.
9,781,970 B2 10/2017 Wardlaw et al.
9,781,974 B2 * 10/2017 Reinhardt ..... B29C 67/04
9,788,598 B2 10/2017 Reinhardt et al.
9,788,606 B2 10/2017 Reinhardt et al.
9,795,186 B2 10/2017 Reinhardt et al.
9,801,428 B2 10/2017 Taylor et al.
9,820,528 B2 11/2017 Reinhardt et al.
9,820,532 B2 11/2017 Cross et al.
D804,159 S 12/2017 Allemann et al.
9,849,645 B2 12/2017 Wardlaw et al.
D808,143 S 1/2018 Negri
9,854,869 B2 * 1/2018 Nordstrom ..... A43B 13/181
9,861,159 B2 1/2018 Kohatsu et al.
D809,252 S 2/2018 Brunner et al.
D809,253 S 2/2018 Brunner et al.
D809,755 S 2/2018 Stavseng et al.
D809,756 S 2/2018 Stavseng et al.
D809,761 S 2/2018 Parrett
D810,407 S 2/2018 DeAlmeida
D811,062 S 2/2018 Teague
9,884,947 B2 2/2018 Prissok et al.
9,894,959 B2 2/2018 Taylor et al.
D813,503 S 3/2018 Brunner et al.
D813,504 S 3/2018 Brunner et al.
D813,508 S 3/2018 Weeks
9,907,357 B2 3/2018 Youngs
9,913,511 B2 3/2018 Peyton et al.
9,926,423 B2 3/2018 Baghdadi
D814,752 S 4/2018 Ormsby
9,930,928 B2 4/2018 Whiteman et al.
9,961,961 B2 5/2018 Smith
9,968,157 B2 5/2018 Wardlaw et al.
9,968,160 B2 5/2018 Peyton
9,981,437 B2 5/2018 Campos et al.
D821,070 S 6/2018 Brunner et al.
9,987,814 B2 6/2018 Campos et al.
D822,957 S 7/2018 Brunner et al.
10,010,136 B2 7/2018 Shaffer et al.
10,039,342 B2 8/2018 Reinhardt et al.
10,051,914 B2 8/2018 Cross et al.
10,051,917 B2 8/2018 Dojan et al.
D828,686 S 9/2018 Hoellmueller et al.
D831,315 S 10/2018 Mahoney
D831,317 S 10/2018 Jenkins et al.
10,098,410 B2 10/2018 Cook et al.
10,098,411 B2 10/2018 Hoffer et al.
10,098,412 B2 10/2018 Hoffer et al.
10,111,492 B2 10/2018 Foxen
10,111,494 B2 10/2018 Cross
D836,893 S 1/2019 Bischoff et al.
10,178,891 B2 1/2019 Christensen et al.
10,182,612 B2 1/2019 Bunnell et al.
D840,135 S 2/2019 Dombrow
D840,136 S 2/2019 Herath et al.
D840,137 S 2/2019 Herath et al.
10,226,099 B2 3/2019 Bischoff
10,227,467 B2 3/2019 Baghdadi
D846,255 S 4/2019 Khalife
D846,256 S 4/2019 Khalife
10,244,821 B2 4/2019 Elder et al.
10,259,183 B2 4/2019 Wardlaw et al.
10,271,613 B2 4/2019 Campos et al.
10,271,615 B2 4/2019 Cross
D847,475 S 5/2019 Khalife
D847,480 S 5/2019 Khalife
10,278,448 B2 5/2019 Cross
10,285,471 B2 5/2019 Cross
10,299,536 B2 5/2019 Ernst et al.
D850,766 S 6/2019 Girard et al.
D851,889 S 6/2019 Dobson et al.
10,327,507 B2 6/2019 Taylor et al.
D852,475 S 7/2019 Hoellmueller
D852,476 S 7/2019 Hartmann
D853,691 S 7/2019 Coonrod et al.
D853,699 S 7/2019 Coonrod et al.
10,433,616 B2 10/2019 Takeshita et al.
10,441,029 B2 10/2019 Campos et al.
10,470,521 B2 11/2019 Tuchi et al.
10,477,919 B2 11/2019 Taylor et al.
10,624,417 B2 4/2020 Dojan et al.
10,645,998 B2 5/2020 Shaffer et al.
10,675,828 B2 6/2020 Campos et al.
10,702,016 B2 7/2020 Youngs
10,721,992 B2 7/2020 Bernhard et al.
10,729,206 B2 8/2020 Campos et al.

(56) References Cited

U.S. PATENT DOCUMENTS 10,743,609 B2 8/2020 Meschter et al.
10,786,039 B2 9/2020 Kohatsu et al.
D900,444 S 11/2020 Brunner et al.
D900,462 S 11/2020 Brunner et al.
D901,866 S 11/2020 Brunner et al.
10,849,387 B2 12/2020 Bruce et al.
10,856,612 B2 12/2020 Heard et al.
10,897,958 B2 1/2021 Peyton et al.
10,939,726 B2 3/2021 Scofield et al.
D923,300 S 6/2021 Brunner et al.
11,147,344 B2 10/2021 Bernhard et al.
11,633,007 B2 * 4/2023 Diard ..... A43B 13/183 36/25 R
11,737,514 B2 * 8/2023 Lyke ..... A43B 13/36 36/28
11,992,082 B2 * 5/2024 Diard ..... A43B 13/125
2002/0071946 A1 6/2002 Norton et al.
2003/0097767 A1 5/2003 Perkinson
2003/0208925 A1 11/2003 Pan
2003/0208929 A1 * 11/2003 Lucas ..... A43B 3/0063 36/27
2004/0088883 A1 * 5/2004 Workman ..... A43B 3/18 36/62
2004/0148805 A1 8/2004 Morris
2004/0154189 A1 8/2004 Wang
2004/0194347 A1 * 10/2004 Aveni ..... A43B 7/1464 36/91
2005/0252038 A1 11/2005 Braunschweiler
2005/0268490 A1 * 12/2005 Foxen ..... A43B 7/1445 36/28
2006/0026863 A1 2/2006 Liu
2006/0130364 A1 * 6/2006 Greene ..... A43B 7/28 36/15
2006/0234012 A1 10/2006 Wang
2006/0248750 A1 11/2006 Rosenberg
2007/0227039 A1 * 10/2007 Chaney ..... A43B 13/12 36/15
2007/0277401 A1 * 12/2007 Young-Chul ..... A43B 13/186 36/28
2008/0127513 A1 6/2008 Schinlder et al.
2008/0148599 A1 6/2008 Collins
2008/0155861 A1 * 7/2008 Lucas ..... A43B 3/0068 36/35 R
2009/0064542 A1 3/2009 Figueroa
2009/0172971 A1 7/2009 Peikert et al.
2010/0107444 A1 * 5/2010 Aveni ..... A43B 13/189 36/35 B
2010/0242309 A1 9/2010 McCann
2010/0263228 A1 * 10/2010 Kang ..... A43B 13/20 36/29
2011/0047720 A1 3/2011 Maranan et al.
2011/0099845 A1 * 5/2011 Miller ..... A43B 7/145 36/91
2011/0197468 A1 8/2011 Kubo et al.
2011/0232135 A1 * 9/2011 Dean ..... B29D 35/142 156/60
2011/0252670 A1 10/2011 Smith
2012/0090200 A1 * 4/2012 Cook ..... A43B 21/37 36/103
2012/0117824 A1 * 5/2012 Kim ..... A43B 13/182 36/105
2012/0227289 A1 * 9/2012 Beers ..... A43B 3/246 12/146 B
2013/0055599 A1 3/2013 Peikert et al.
2013/0059116 A1 3/2013 Peikert et al.
2013/0145653 A1 6/2013 Bradford
2013/0160223 A1 6/2013 Bier et al.
2013/0160324 A1 * 6/2013 Peyton ..... A43B 13/141 36/83
2013/0212908 A1 * 8/2013 Hsu ..... A43B 13/188 36/101
2013/0233477 A1 9/2013 Bier et al.
2013/0291409 A1 * 11/2013 Reinhardt ..... A43B 13/14 36/43
2013/0312284 A1 11/2013 Berend et al.
2014/0033574 A1 2/2014 Wan
2014/0075777 A1 * 3/2014 Bruce ..... A43B 7/148 36/29
2014/0075779 A1 * 3/2014 Bruce ..... A43B 7/148 36/29
2014/0086504 A1 3/2014 Arai
2014/0151918 A1 6/2014 Hartmann
2014/0196308 A1 7/2014 Baratta et al.
2014/0208610 A1 7/2014 Dirsa et al.
2014/0223776 A1 8/2014 Wardlaw et al.
2014/0223777 A1 8/2014 Whiteman et al.
2014/0259745 A1 9/2014 Vaglio
2014/0325876 A1 * 11/2014 Dodge ..... A43B 13/141 36/103
2015/0096203 A1 4/2015 Brown et al.
2015/0272272 A1 * 10/2015 Scofield ..... A43B 1/0009 36/28
2016/0007676 A1 1/2016 Leimer et al.
2016/0037859 A1 2/2016 Smith et al.
2016/0044992 A1 2/2016 Reinhardt et al.
2016/0120260 A1 5/2016 Hansen et al.
2016/0150854 A1 * 6/2016 Hockerson ..... A43B 7/1435 36/28
2016/0183633 A1 * 6/2016 Scofield ..... A43B 13/20 36/29
2016/0227876 A1 8/2016 Le et al.
2016/0278481 A1 9/2016 Le et al.
2016/0295955 A1 10/2016 Wardlaw et al.
2016/0345665 A1 12/2016 Kohatsu et al.
2016/0374428 A1 12/2016 Kormann et al.
2017/0006958 A1 1/2017 Jeong
2017/0105478 A1 4/2017 Cross et al.
2017/0172251 A1 6/2017 Douglas
2017/0245581 A1 8/2017 McFarland et al.
2017/0245582 A1 8/2017 Green et al.
2017/0253710 A1 9/2017 Smith et al.
2017/0258178 A1 9/2017 Cross et al.
2017/0258180 A1 9/2017 Cross et al.
2017/0259474 A1 9/2017 Holmes et al.
2017/0332727 A1 * 11/2017 Beck ..... A43B 13/188
2017/0341325 A1 11/2017 Le et al.
2017/0354568 A1 12/2017 Brown et al.
2018/0000197 A1 1/2018 Wardlaw et al.
2018/0027922 A1 2/2018 Orand
2018/0035755 A1 2/2018 Reinhardt et al.
2018/0049509 A1 2/2018 Zwick et al.
2018/0064210 A1 3/2018 Turner et al.
2018/0077997 A1 3/2018 Hoffer et al.
2018/0077998 A1 3/2018 Nordstrom
2018/0092432 A1 4/2018 Hoffer et al.
2018/0098602 A1 4/2018 Kohatsu et al.
2018/0100049 A1 4/2018 Prissok et al.
2018/0103719 A1 4/2018 Chen
2018/0103725 A1 4/2018 Chen
2018/0110292 A1 4/2018 Beers et al.
2018/0116327 A9 5/2018 McFarland et al.
2018/0125156 A1 5/2018 Bray, Jr.
2018/0125157 A1 5/2018 Bray, Jr.
2018/0132487 A1 5/2018 Kormann et al.
2018/0153264 A1 6/2018 Amos et al.
2018/0154598 A1 6/2018 Kurtz et al.
2018/0199667 A1 7/2018 Wang
2018/0206591 A1 7/2018 Whiteman et al.
2018/0206599 A1 7/2018 Amos et al.
2018/0213886 A1 * 8/2018 Connell ..... A43B 13/141
2018/0235310 A1 8/2018 Wardlaw et al.
2018/0242686 A1 * 8/2018 Pilto ..... A43B 3/244
2018/0255870 A1 * 9/2018 Oda ..... A43B 7/1415
2018/0263336 A1 9/2018 Dekovic et al.
2018/0289108 A1 10/2018 Hoffer et al.
2018/0289109 A1 10/2018 Beers et al.
2018/0303198 A1 10/2018 Reinhardt et al.
2018/0325217 A1 11/2018 Dojan et al.
2018/0338569 A1 11/2018 Cross et al.
2018/0338572 A1 * 11/2018 Cross ..... A43B 13/04
2018/0352900 A1 * 12/2018 Hartmann ..... A43B 13/04

(56) References Cited

U.S. PATENT DOCUMENTS

| | | | | |
|---|---|---|---|---|
| 2018/0368519 | A1* | 12/2018 | Lilley | A43B 13/04 |
| 2019/0037964 | A1 | 2/2019 | Foxen | |
| 2019/0082782 | A1 | 3/2019 | Bunnell et al. | |
| 2019/0126580 | A1 | 5/2019 | Paulson et al. | |
| 2019/0133251 | A1 | 5/2019 | Hartmann et al. | |
| 2019/0142103 | A1 | 5/2019 | Christensen et al. | |
| 2019/0150564 | A1 | 5/2019 | Bischoff | |
| 2019/0216167 | A1 | 7/2019 | Hoffer et al. | |
| 2019/0216168 | A1 | 7/2019 | Hoffer et al. | |
| 2019/0223539 | A1 | 7/2019 | Hoffer et al. | |
| 2019/0223550 | A1 | 7/2019 | Levy | |
| 2019/0223551 | A1 | 7/2019 | Hoffer et al. | |
| 2019/0246738 | A1* | 8/2019 | Connell | A43B 13/186 |
| 2019/0261739 | A1 | 8/2019 | Taylor et al. | |
| 2019/0281921 | A1 | 9/2019 | Bray, Jr. | |
| 2019/0291371 | A1 | 9/2019 | Wardlaw et al. | |
| 2019/0380435 | A1 | 12/2019 | Campos et al. | |
| 2020/0196704 | A1 | 6/2020 | Dojan et al. | |
| 2020/0205514 | A1* | 7/2020 | VanDomelen | A43B 13/188 |
| 2020/0260820 | A1 | 8/2020 | Youngs | |
| 2020/0262167 | A1 | 8/2020 | Campos et al. | |
| 2020/0297071 | A1* | 9/2020 | Troufanov | A43B 13/189 |
| 2020/0315291 | A1 | 10/2020 | Tucker | |
| 2020/0375308 | A1 | 12/2020 | Langvin et al. | |
| 2021/0030112 | A1* | 2/2021 | Amoako | A43B 13/20 |
| 2021/0052037 | A1 | 2/2021 | Greenspan et al. | |
| 2021/0112917 | A1* | 4/2021 | Bock | A43B 13/223 |
| 2021/0127782 | A1* | 5/2021 | DeVoe | A43B 13/04 |
| 2021/0235813 | A1* | 8/2021 | Hartmann | A43B 13/181 |
| 2021/0237383 | A1* | 8/2021 | Bonin | A43B 13/32 |
| 2021/0274886 | A1* | 9/2021 | Morsell | A61F 5/14 |
| 2021/0368918 | A1* | 12/2021 | Lyke | A43B 13/20 |
| 2021/0368921 | A1* | 12/2021 | Campos, II | A43B 13/189 |
| 2021/0368922 | A1* | 12/2021 | Ho | A43B 13/20 |
| 2022/0022597 | A1* | 1/2022 | Bowman | A43B 13/189 |
| 2022/0031017 | A1 | 2/2022 | Heitz et al. | |
| 2022/0031018 | A1 | 2/2022 | Bernhard et al. | |
| 2022/0095740 | A1* | 3/2022 | Troufanov | A43B 13/186 |
| 2022/0104584 | A1* | 4/2022 | Bazan | A43B 3/244 |
| 2022/0110408 | A1* | 4/2022 | Coonrod | B33Y 80/00 |
| 2022/0125158 | A1* | 4/2022 | Ni | A43B 13/026 |
| 2022/0203611 | A1 | 6/2022 | Bernhard et al. | |
| 2022/0240626 | A1 | 8/2022 | Bernhard et al. | |
| 2022/0248804 | A1* | 8/2022 | Chang | A43B 13/20 |
| 2022/0361632 | A1* | 11/2022 | Maselino | A43B 13/16 |
| 2023/0027940 | A1* | 1/2023 | Diard | A43B 13/125 |
| 2023/0029846 | A1* | 2/2023 | Livne | A43B 13/122 |
| 2023/0157412 | A1* | 5/2023 | Sussmann | A43B 3/246 36/25 R |
| 2023/0270207 | A1* | 8/2023 | Stauffer | A43B 13/16 36/28 |
| 2023/0284741 | A1* | 9/2023 | Diard | A43B 13/125 |
| 2023/0292877 | A1* | 9/2023 | Galasso | A43B 3/244 36/15 |
| 2024/0057715 | A1* | 2/2024 | Peyton | A43B 13/189 |
| 2024/0156207 | A1* | 5/2024 | Fauconnier | A43B 13/181 |
| 2024/0335003 | A1* | 10/2024 | Eldem | A43B 13/20 |

FOREIGN PATENT DOCUMENTS

| | | | |
|---|---|---|---|
| AU | 367102 | S | 2/2016 |
| AU | 367132 | S | 2/2016 |
| AU | 201616565 | S | 12/2016 |
| AU | 201911227 | S | 4/2019 |
| AU | 201911228 | S | 4/2019 |
| BR | 302016005366 | S1 | 10/2017 |
| BR | 302018055276 | S1 | 2/2019 |
| BR | 302018002647 | S1 | 8/2019 |
| BR | 302019001134 | S1 | 8/2019 |
| CN | 1285779 | A | 2/2001 |
| CN | 1334054 | A | 2/2002 |
| CN | 1653982 | A | 8/2005 |
| CN | 2790218 | A | 6/2006 |
| CN | 101299941 | A | 11/2008 |
| CN | 201226862 | Y | 4/2009 |
| CN | 101537675 | A | 9/2009 |
| CN | 201813947 | U | 5/2011 |
| CN | 102273769 | A | 12/2011 |
| CN | 102481746 | A | 5/2012 |
| CN | 102729502 | | 10/2012 |
| CN | 104256997 | A | 1/2015 |
| CN | 105025745 | A | 11/2015 |
| CN | 105192992 | | 12/2015 |
| CN | 105476176 | A | 4/2016 |
| CN | 105595519 | A | 5/2016 |
| CN | 304114391 | S | 4/2017 |
| CN | 106939097 | A | 7/2017 |
| CN | 107048591 | A | 8/2017 |
| CN | 206808782 | U | 12/2017 |
| DE | 3440206 | A1 | 5/1985 |
| DE | 202005017043 | U1 | 3/2007 |
| DE | 50308731 | | 1/2008 |
| DE | 202012010878 | U1 | 1/2013 |
| DE | 202012010879 | U1 | 1/2013 |
| DE | 202014003016 | U1 | 5/2014 |
| DE | 102015118251 | A1 | 4/2017 |
| DE | 502016014813 | | 5/2022 |
| DE | 502019010599 | | 3/2024 |
| DE | 502019010635 | | 3/2024 |
| DM | 102274006 | | 8/2018 |
| DM | 103418013 | | 9/2018 |
| EM | 001286116-0005 | | 7/2011 |
| EM | 002219956-0024 | | 5/2013 |
| EM | 002772764-0015 | | 2/2016 |
| EM | 003165984-0005 | | 6/2016 |
| EM | 003039619-0034 | | 7/2016 |
| EM | 003315555-0001 | | 8/2016 |
| EM | 003316389-0001 | | 8/2016 |
| EM | 003330174-0003 | | 8/2016 |
| EM | 003344076-0002 | | 9/2016 |
| EM | 003362672-0001 | | 9/2016 |
| EM | 003718311-0019 | | 2/2017 |
| EM | 003761089-0028 | | 5/2017 |
| EM | 004363935-0008 | | 10/2017 |
| EM | 004386571-0002 | | 10/2017 |
| EM | 004366326-0001 | | 11/2017 |
| EM | 003761113-0025 | | 12/2017 |
| EM | 004675411-0006 | | 1/2018 |
| EM | 004543882-0008 | | 5/2018 |
| EM | 005243227-0002 | | 5/2018 |
| EM | 005260023-0003 | | 5/2018 |
| EM | 005278413-0002 | | 5/2018 |
| EM | 005320371-0002 | | 7/2018 |
| EM | 005841939-0004 | | 12/2018 |
| EM | 003649060-0005 | | 1/2019 |
| EM | 004352755-0004 | | 1/2019 |
| EM | 005612025-0001 | | 1/2019 |
| EM | 004812501-0004 | | 2/2019 |
| EM | 005191004-0010 | | 2/2019 |
| EM | 006335345-0003 | | 4/2019 |
| EM | 003522580-0029 | | 6/2019 |
| EM | 003649540-0001 | | 7/2019 |
| EP | 1021965 | A2 | 7/2000 |
| EP | 1164884 | A1 | 1/2002 |
| EP | 1033924 | B1 | 9/2003 |
| EP | 1563750 | A1 | 8/2005 |
| EP | 1991078 | A1 | 11/2008 |
| EP | 2074901 | A1 | 7/2009 |
| EP | 2103420 | A2 | 9/2009 |
| EP | 1979401 | B1 | 9/2010 |
| EP | 1753314 | B1 | 1/2011 |
| EP | 2490561 | A1 | 8/2012 |
| EP | 2197309 | B1 | 11/2012 |
| EP | 1991728 | B1 | 1/2013 |
| EP | 2319343 | B1 | 5/2013 |
| EP | 2609824 | A1 | 7/2013 |
| EP | 2611323 | A1 | 7/2013 |
| EP | 2369952 | B1 | 12/2013 |
| EP | 2332432 | A4 | 1/2014 |
| EP | 2490564 | B1 | 1/2014 |
| EP | 2568841 | B1 | 7/2014 |
| EP | 2786670 | A1 | 10/2014 |
| EP | 2559351 | B1 | 1/2015 |

(56) References Cited

FOREIGN PATENT DOCUMENTS

| | | | |
|---|---|---|---|
| EP | 2724635 | B1 | 3/2015 |
| EP | 1796493 | B1 | 4/2015 |
| EP | 2227107 | B1 | 4/2015 |
| EP | 2676562 | B1 | 4/2015 |
| EP | 2870892 | A1 | 5/2015 |
| EP | 2298109 | B1 | 7/2015 |
| EP | 2197307 | B1 | 8/2015 |
| EP | 2611321 | B1 | 8/2015 |
| EP | 2227106 | B1 | 2/2016 |
| EP | 2984956 | A1 | 2/2016 |
| EP | 3001922 | A1 | 4/2016 |
| EP | 3001923 | A1 | 4/2016 |
| EP | 3027377 | A1 | 6/2016 |
| EP | 2506735 | B1 | 7/2016 |
| EP | 3041892 | A1 | 7/2016 |
| EP | 2197311 | B1 | 8/2016 |
| EP | 2649896 | B1 | 10/2016 |
| EP | 3078287 | A1 | 10/2016 |
| EP | 2897483 | B1 | 12/2016 |
| EP | 3114954 | A1 | 1/2017 |
| EP | 3114955 | A1 | 1/2017 |
| EP | 3114956 | A1 | 1/2017 |
| EP | 3114959 | A1 | 1/2017 |
| EP | 2713794 | B1 | 4/2017 |
| EP | 2937008 | B1 | 7/2017 |
| EP | 3186306 | A1 | 7/2017 |
| EP | 2897484 | B1 | 8/2017 |
| EP | 3200640 | A1 | 8/2017 |
| EP | 2467037 | B1 | 10/2017 |
| EP | 2227108 | B1 | 11/2017 |
| EP | 2872309 | B1 | 11/2017 |
| EP | 2910140 | B1 | 12/2017 |
| EP | 2979566 | B1 | 12/2017 |
| EP | 3267818 | A1 | 1/2018 |
| EP | 3267820 | A1 | 1/2018 |
| EP | 3267822 | A1 | 1/2018 |
| EP | 3267823 | A1 | 1/2018 |
| EP | 3267824 | A2 | 1/2018 |
| EP | 3267826 | A1 | 1/2018 |
| EP | 2229067 | B1 | 2/2018 |
| EP | 2910141 | B1 | 2/2018 |
| EP | 2929791 | B1 | 3/2018 |
| EP | 3289907 | A1 | 3/2018 |
| EP | 3302143 | A1 | 4/2018 |
| EP | 3308663 | A1 | 4/2018 |
| EP | 3318150 | A1 | 5/2018 |
| EP | 3338581 | A1 | 6/2018 |
| EP | 3338582 | A1 | 6/2018 |
| EP | 3346862 | A1 | 7/2018 |
| EP | 2793630 | B1 | 8/2018 |
| EP | 2845504 | B1 | 8/2018 |
| EP | 3352607 | A1 | 8/2018 |
| EP | 3352608 | A1 | 8/2018 |
| EP | 3352610 | A1 | 8/2018 |
| EP | 3352611 | A1 | 8/2018 |
| EP | 3352612 | A1 | 8/2018 |
| EP | 3352615 | A1 | 8/2018 |
| EP | 3338984 | A3 | 9/2018 |
| EP | 2897482 | B1 | 10/2018 |
| EP | 2948012 | B1 | 10/2018 |
| EP | 3381311 | A1 | 10/2018 |
| EP | 3391767 | A1 | 10/2018 |
| EP | 2764787 | B1 | 11/2018 |
| EP | 3412164 | A1 | 12/2018 |
| EP | 3416516 | A1 | 12/2018 |
| EP | 2611322 | B1 | 1/2019 |
| EP | 3423621 | A1 | 1/2019 |
| EP | 3434128 | A1 | 1/2019 |
| EP | 3243400 | B1 | 3/2019 |
| EP | 3010362 | B1 | 4/2019 |
| EP | 3466291 | A1 | 4/2019 |
| EP | 3248770 | B1 | 5/2019 |
| EP | 3348160 | B1 | 5/2019 |
| EP | 3476237 | A1 | 5/2019 |
| EP | 3484320 | A1 | 5/2019 |
| EP | 3185712 | B1 | 6/2019 |
| EP | 3284362 | B1 | 7/2019 |
| EP | 3386334 | B1 | 7/2019 |
| EP | 3534743 | A1 | 9/2019 |
| EP | 3692852 | A1 | 8/2020 |
| EP | 3692854 | A1 | 8/2020 |
| EP | 3721739 | A1 | 10/2020 |
| EP | 3429391 | B1 | 11/2020 |
| EP | 3095344 | B1 | 12/2020 |
| EP | 3250073 | B1 | 12/2020 |
| EP | 3597067 | B1 | 2/2021 |
| EP | 3785562 | A1 | 3/2021 |
| GB | 350493 | A | 6/1931 |
| GB | 80830100001000 | S | 8/2014 |
| GB | 80865610001000 | S | 11/2015 |
| GB | 80865620001000 | S | 11/2015 |
| GB | 80913230001000 | S | 5/2016 |
| GB | 80908830006000 | S | 11/2016 |
| GB | 80913220001000 | S | 11/2016 |
| GB | 80913240001000 | S | 11/2016 |
| GB | 80929060001000 | S | 3/2017 |
| GB | 81031770001000 | S | 12/2018 |
| GB | 82000680001000 | S | 5/2019 |
| GB | 82052540002000 | S | 1/2020 |
| IT | 202200034259 | T2 | 4/2022 |
| JP | 2002526126 | A | 8/2002 |
| JP | 2010158511 | A | 7/2010 |
| JP | 5465814 | B1 | 4/2014 |
| JP | 2016202903 | A | 12/2016 |
| JP | 1576023 | S | 5/2017 |
| JP | 1587379 | S | 10/2017 |
| JP | 1587380 | S | 10/2017 |
| JP | 1587383 | S | 10/2017 |
| JP | 1587384 | S | 10/2017 |
| JP | 1587413 | S | 10/2017 |
| JP | 1597010 | S | 2/2018 |
| JP | 1600181 | S | 3/2018 |
| JP | 1658933 | S | 5/2020 |
| JP | 1674560 | S | 12/2020 |
| JP | 1685374 | S | 5/2021 |
| JP | 1689233 | S | 7/2021 |
| KR | 101162721 | B1 | 7/2012 |
| KR | 101567716 | B1 | 11/2015 |
| KR | DM086562001 | S1 | 9/2016 |
| KR | DM090883001 | S1 | 5/2017 |
| KR | DM090883002 | S1 | 5/2017 |
| KR | DM090883003 | S1 | 5/2017 |
| KR | DM090883004 | S1 | 5/2017 |
| KR | DM090883005 | S1 | 5/2017 |
| KR | DM090883006 | S1 | 5/2017 |
| KR | DM090883007 | S1 | 5/2017 |
| KR | DM090883008 | S1 | 5/2017 |
| KR | DM091322001 | S1 | 5/2017 |
| KR | DM091324001 | S1 | 5/2017 |
| KR | DM103177002 | S1 | 4/2020 |
| KR | DM205254001 | S1 | 1/2021 |
| KR | DM205254002 | S1 | 1/2021 |
| KR | 1020210106456 | A | 8/2021 |
| KR | 1020210108386 | A | 9/2021 |
| MX | 49996 | S | 7/2017 |
| MX | 49997 | S | 7/2017 |
| MX | 50693 | S | 9/2017 |
| MX | 53296 | S | 9/2018 |
| MX | 59399 | S | 1/2021 |
| MX | 60398 | S | 4/2021 |
| MX | 60717 | S | 6/2021 |
| MX | 62125 | S | 10/2021 |
| MX | 387951 | B | 12/2021 |
| NO | 0865610001 | S | 11/2015 |
| NO | 0865620001 | S | 11/2015 |
| NO | 0908830007 | S | 11/2016 |
| NO | 0913220001 | S | 11/2016 |
| NO | 0913230001 | S | 11/2016 |
| NO | 0913240001 | S | 11/2016 |
| NO | 0929060001 | S | 3/2017 |
| NO | 3297485 | B1 | 3/2018 |
| NO | 1031770001 | S | 12/2018 |
| NO | 2000680002 | S | 5/2019 |
| NO | 2052540001 | S | 1/2020 |

(56) References Cited

FOREIGN PATENT DOCUMENTS

| | | | |
|---|---|---|---|
| RU | 2786607 | C1 | 12/2022 |
| RU | 2791498 | C2 | 3/2023 |
| TH | 2101002977 | A | 6/2022 |
| TH | 2101003051 | A | 6/2022 |
| WO | 2006112622 | A1 | 10/2006 |
| WO | 20100084367 | A1 | 10/2006 |
| WO | 2010021517 | A2 | 2/2010 |
| WO | 083010 | S | 2/2014 |
| WO | 2015017088 | A1 | 2/2015 |
| WO | 086561 | S | 11/2015 |
| WO | 086562 | S | 11/2015 |
| WO | 2000051458 | A1 | 11/2015 |
| WO | 2015175605 | A1 | 11/2015 |
| WO | 2016030026 | A1 | 3/2016 |
| WO | 2016030333 | A1 | 3/2016 |
| WO | 2016053443 | A1 | 4/2016 |
| WO | 2016144406 | A1 | 9/2016 |
| WO | 2016144407 | A1 | 9/2016 |
| WO | 2016144408 | A1 | 9/2016 |
| WO | 2016144409 | A1 | 9/2016 |
| WO | 2016144410 | A1 | 9/2016 |
| WO | 2016144413 | A1 | 9/2016 |
| WO | 090883 | S | 11/2016 |
| WO | 091322 | S | 11/2016 |
| WO | 091323 | S | 11/2016 |
| WO | 091324 | S | 11/2016 |
| WO | 2016191109 | A1 | 12/2016 |
| WO | 092906 | S | 3/2017 |
| WO | 2017042127 | A1 | 3/2017 |
| WO | 2017053650 | A1 | 3/2017 |
| WO | 2017053654 | A1 | 3/2017 |
| WO | 2017053658 | A1 | 3/2017 |
| WO | 2017053665 | A1 | 3/2017 |
| WO | 2017053669 | A1 | 3/2017 |
| WO | 2017053674 | A1 | 3/2017 |
| WO | 2017053692 | A1 | 3/2017 |
| WO | 2017097315 | A1 | 6/2017 |
| WO | 2017142857 | A1 | 8/2017 |
| WO | 2017151496 | A1 | 9/2017 |
| WO | 2017160730 | A1 | 9/2017 |
| WO | 2018011030 | A1 | 1/2018 |
| WO | 2018083676 | A1 | 5/2018 |
| WO | 2018099833 | A1 | 6/2018 |
| WO | 2018103811 | A1 | 6/2018 |
| WO | 2018169535 | A1 | 9/2018 |
| WO | 2018169537 | A1 | 9/2018 |
| WO | 2018192262 | A1 | 10/2018 |
| WO | 103177 | S | 12/2018 |
| WO | 2019029781 | A1 | 2/2019 |
| WO | 2019073607 | A1 | 4/2019 |
| WO | 200068 | S | 5/2019 |
| WO | 2019101339 | A1 | 5/2019 |
| WO | 2019150492 | A1 | 8/2019 |
| WO | 2019157244 | A1 | 8/2019 |
| WO | 205254 | S | 1/2020 |
| WO | 2020016105 | A1 | 1/2020 |
| WO | 2020099439 | A1 | 5/2020 |
| WO | 2020142429 | A1 | 7/2020 |
| WO | 2020193034 | A1 | 10/2020 |
| WO | 2020206240 | A1 | 10/2020 |
| WO | 2020243385 | A1 | 12/2020 |
| WO | 2021041269 | A1 | 3/2021 |

OTHER PUBLICATIONS

International Search Report and Written Opinion for International Application No. PCT/IB2022/059752, mailed Feb. 2, 2023 (17 pages).

Bicycling Catalog 39 Giant Phase 2 Road Shoe <https://www.camdenbikes.com/> [online] [retrieved on Jul. 19, 2019] (3 pages).

Bicycling Catalog 39 <https://www.berkshirebikeandboard.com/> [online] [retrieved on Jul. 19, 2019] (4 pages).

Hot pressing film TPU film for bonding synthetic leather and mesh fabric together on shoes upper <https://www.alibaba.com/?from_http=1> [online] [retrieved on Jul. 19, 2019] (5 pages).

International Search Report of related International Application No. PCT/EP2018/061934 mailed Jan. 17, 2019, 6 pages.

International Search Report of related International Application No. PCT/EP2018/061935, mailed Jan. 18, 2019, 7 pages.

Written Opinion of related International Application No. PCT/EP2018/061935, mailed Jan. 18, 2019, 6 pages.

First Office Action from related Chinese Patent Application No. 201880093277_X dated Nov. 26, 2021 (14 pages) including English translation.

"The History of On (Running)", https://blog.finishline.com, 2022, Retrieved from the Internet: URL: https://blog.finishline.com/the-history-of-on-running/ [Retrieved Jun. 18, 2024].

Law, Brandon: "On Cloudsurfer 7 Review", https://runningshoeguru.com, Apr. 6, 2023, Retrieved from the Internet: URL: https://www.runningshoesguru.com/reviews/road/on-cloudsurfer-7-review/ [Retrieved Jun. 18, 2024].

Lassen, Kristin: "On Cloudflyer 4 Review", https://runningshoeguru.com, May 7, 2023, Retrieved from the Internet: URL: https://www.runningshoesguru.com/reviews/road/on-cloudflyer-4-review/ [Retrieved Jun. 18, 2024].

"History of On Running & On Cloud Shoes", https://blog.jdsports.com, 2022, Retrieved from the Internet: URL: https://blog.jdsports.com/history-of-on-running-on-cloud-shoes/ [Retrieved Jun. 18, 2024].

RoadTrailRun: "2019 On Running Previews: Cloudswift & Cloudstratus", https://youtube.com, Nov. 29, 2018, Retrieved from the Internet: URL: https://www.youtube.com/watch?v=4D259Gb2NmE [Retrieved Jun. 18, 2024].

On: "On | Cloudrock Waterproof—our first lightweight hiking shoe made for speed", https://youtube.com, Jul. 18, 2019, Retrieved from the Internet: URL: https://www.youtube.com/watch?app=desktop&v=JqS75kvmPls&vl=it [Retrieved Jun. 18, 2024].

Baham, Ryan: "On Cloud X Review", https://outdoorgearlab.com, Feb. 19, 2020, Retrieved from the Internet: URL: https://www.outdoorgearlab.com/reviews/shoes-and-boots/running-shoes-men/on-cloud-x [Retrieved Jun. 18, 2024].

European Search Report in corresponding Application No. 23209283 dated Feb. 23, 2024, 8 pages.

* cited by examiner

ARTICLE OF FOOTWEAR HAVING EXCHANGEABLE PODS

CROSS REFERENCE TO RELATED APPLICATIONS

This application claims the benefit of and priority to U.S. Provisional Application No. 63/425,208, filed on Nov. 14, 2022, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including an outsole and a midsole with pods that are exchangeable and replaceable.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and chosen for use based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, conventional shoes generally have a midsole and an outsole which are not designed to be individually replaceable or separated from the conventional shoe. When the outsole or the midsole wear out, most conventional shoes are discarded. Moreover, conventional shoes generally lack a mechanism to swap out a first midsole for a second midsole. As a result, conventional shoes are limited to the performance offered by the midsole, and are not designed to allow a user to select amongst several midsole elements that provide a variety of beneficial configurations, thereby allowing a wider selection of applications of the shoe. Therefore, there is a need for an article of footwear that allows for selective replacement of the outsole and/or elements of the midsole.

SUMMARY

An article of footwear, as described herein, may have various configurations. The article of footwear may have an upper and a sole structure connected to the upper.

In some aspects, an article of footwear includes an upper attached to a stabilizer, an outsole, a first pod, and a second pod. The stabilizer has a lower surface and a first securing mechanism. The outsole has a first retention mechanism and an interior surface. The first securing mechanism is configured to be retained by the first retention mechanism. A volume between the lower surface and the interior surface forms a midsole cavity. The midsole cavity is configured to receive the first pod and the second pod.

In some embodiments, the first pod has a first top surface opposite a first bottom surface, and the second pod has a second top surface opposite a second bottom surface. In some embodiments, the first pod is secured to the lower surface or the interior surface. In some embodiments, the first pod is secured to the lower surface or the interior surface by an adhesive, or by welding. In some embodiments, the first securing mechanism is a tab, and the first retention mechanism is an aperture that is configured to be selectively retained by the tab. In some embodiments, the first retention mechanism is secured to the first securing mechanism at a heel end of the upper and the stabilizer is molded to the outsole at a toe end of the upper. In some embodiments, the outsole is configured to rotate with respect to the stabilizer when the first securing mechanism is not retained by the first retention mechanism.

In some aspects, an article of footwear includes an upper attached to a stabilizer, an outsole, and at least two pods. The stabilizer has a lower surface and a first securing mechanism. The outsole has a first retention mechanism and an interior surface. The first retention mechanism is configured to be selectively retained by the first securing mechanism. A volume between the lower surface and the interior surface forms a midsole cavity that includes a forward pod region.

The forward pod region is configured to receive one of the at least two pods, and the one of the at least two pods can be exchanged with the other of the at least two pods in the forward pod region.

In some embodiments, the midsole cavity includes a rear pod region that is configured to receive one of the at least two pods. In some embodiments, when the first retention mechanism is secured to the first securing mechanism, one of at least two pods is retained in the midsole cavity. In some embodiments, the at least two pods comprises a first pod, a second pod, and a third pod, and the third pod is configured to be exchanged with the first pod or the second pod. In some embodiments, the first pod has a first stiffness, the second pod has a second stiffness greater than the first stiffness, and the third pod has a third stiffness greater than the second stiffness. In some embodiments, a first cushioning effect of the article of footwear can be changed by exchanging the first pod for the second pod or the third pod. In some embodiments, a second cushioning effect can be achieved by inserting the first pod in the forward pod region, and the second pod in the rear pod region, and a third cushioning effect can be achieved by exchanging the first pod with the second or the third pod.

In some aspects, a method of exchanging pods in an article of footwear includes providing an upper attached to a stabilizer that has a lower surface and a first securing mechanism. The method further includes providing an outsole that is pivotably secured to the stabilizer and has a first retention mechanism and an interior surface. In addition, the method comprises providing a first pod and a second pod.

In some embodiments, the method includes releasing the first retention mechanism from the first securing mechanism and pivoting the outsole away from the stabilizer. In some embodiments, the method includes securing the first pod and the second pod to the outsole or the stabilizer. In some embodiments, the method includes securing the first pod or the second pod using adhesive or welding. In some embodiments, the method includes rotating the outsole toward the stabilizer and securing the first securing mechanism to the first retention mechanism. In some embodiments, the method includes securing the first pod or the second pod to the outsole or the stabilizer, providing a third pod different from the first pod and the second pod, and replacing the first pod or the second pod with the third pod.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
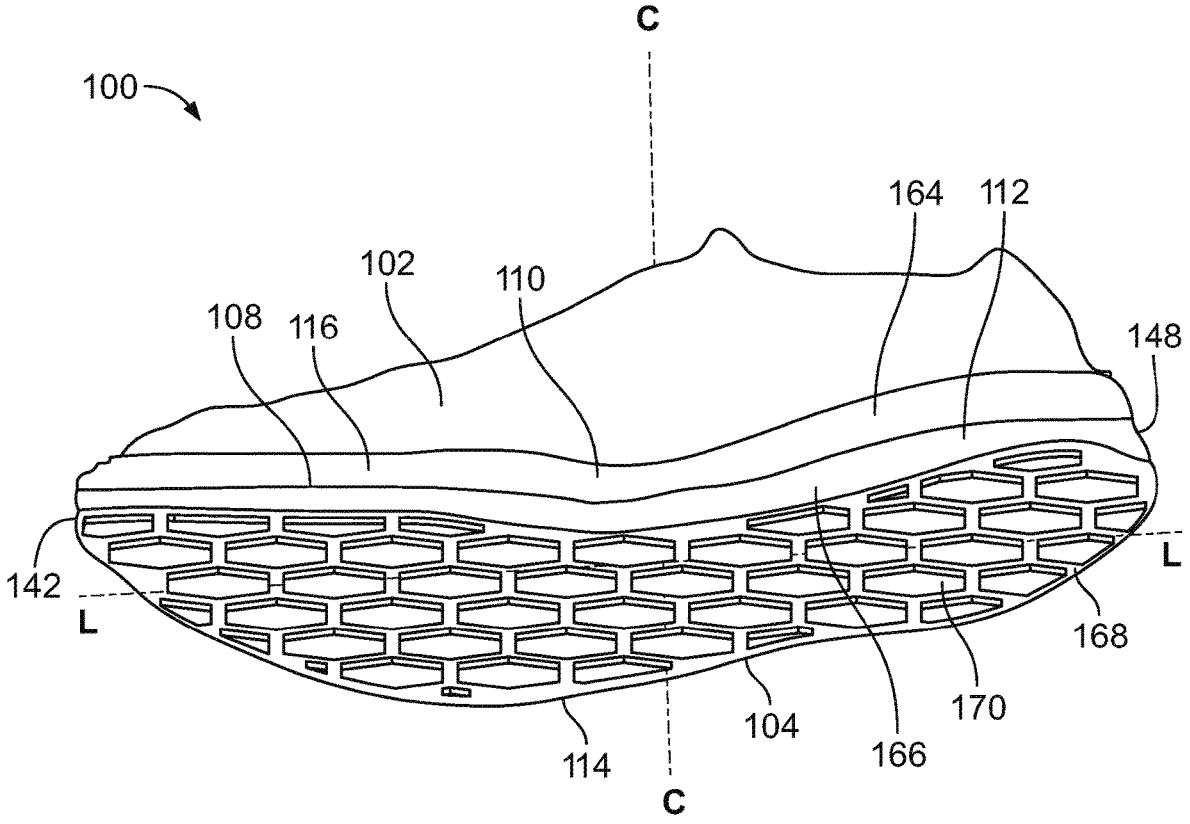
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about"

and "approximately" refer to a range of values±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
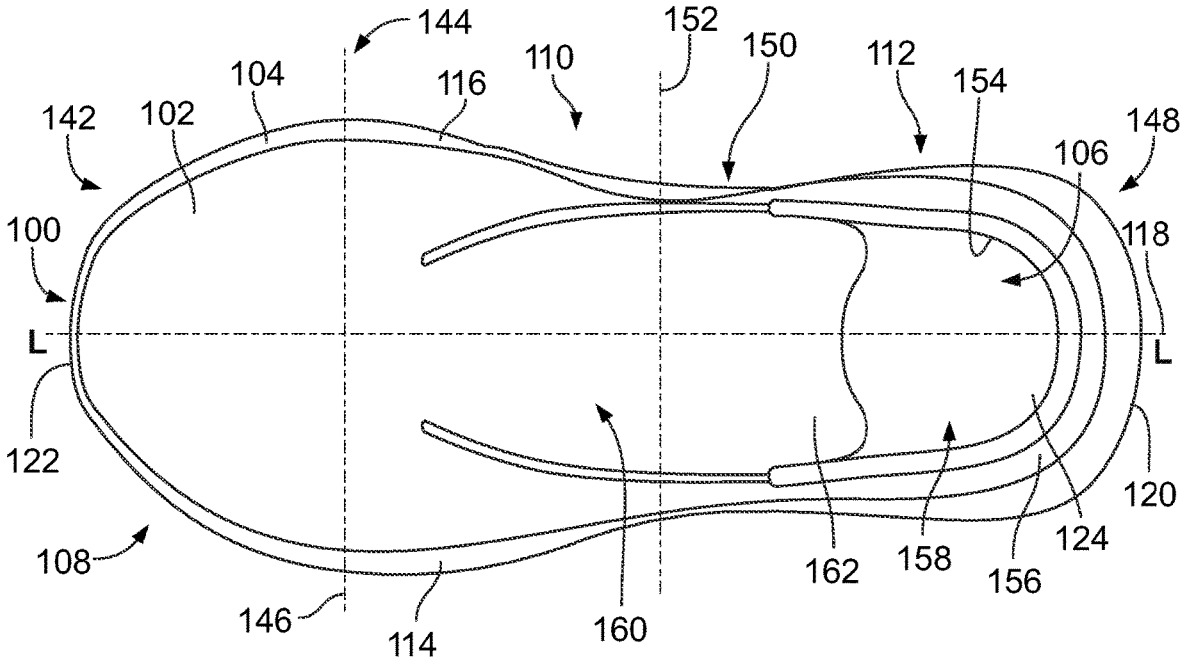
FIG. 2 is a top view of the article of footwear of FIG. 1 configured as a left shoe.
Figure 3:
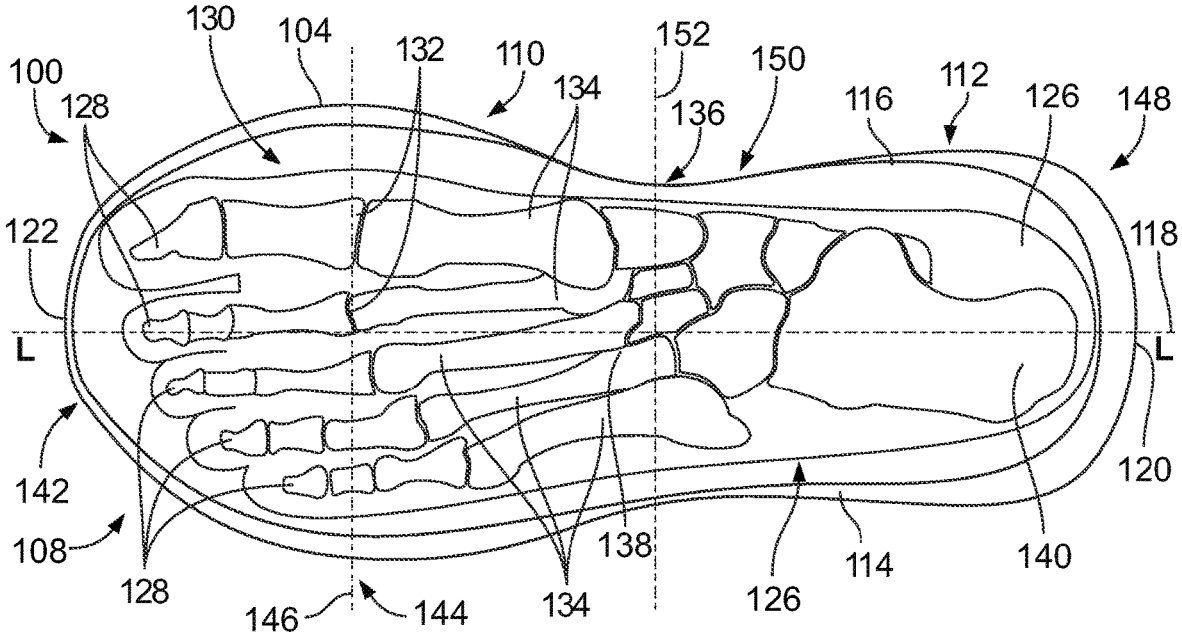
FIG. 3 is a top plan view of the article of footwear of FIG. 1 configured as a left shoe with the upper removed and a user's skeletal foot structure overlaid thereon.

FIGS. 1-3 depict an exemplary embodiment of an article of footwear 100 including an upper 102 (see FIGS. 1 and 2) and a sole structure 104. The upper 102 is attached to the sole structure 104 and together define an interior cavity 106 (see FIG. 2) into which a foot may be inserted. For reference, the article of footwear 100 defines a forefoot region 108, a midfoot region 110, and a heel region 112. The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements (e.g., textiles, polymer foam, polymer sheets, leather, and synthetic leather) that are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

Referring to FIGS. 1 and 2, with reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

Still referring to FIGS. 1 and 2, in some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

The sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Still referring to FIGS. 1 and 2, furthermore, the insole can be positioned within the interior cavity of the upper, which can be in direct contact with a user's foot while an article of footwear is being worn. Moreover, an upper may also include a liner (not shown) that can increase comfort, for example, by reducing friction between the foot of the user and the upper, the sole, the insole, or the like, and/or by providing moisture wicking properties. The liner may line the entirety of the interior cavity or only a portion thereof. In some embodiments, a binding (not shown) may surround the opening of the interior cavity to secure the liner to the upper and/or to provide an aesthetic element on the article of footwear.

Referring to FIGS. 2 and 3, the article of footwear 100 also defines a lateral side 114 and a medial side 116. When a user is wearing the shoes, the lateral side 114 corresponds with an outside-facing portion of the article of footwear 100 while the medial side 116 corresponds with an inside-facing portion of the article of footwear 100. As such, the article of footwear 100 has opposing lateral sides 114 and medial sides 116. The medial side 116 and the lateral side 114 adjoin one another along a longitudinal central plane or central axis 118 of the article of footwear 100, which is coplanar with the longitudinal axis L of FIG. 1. As will be further discussed herein, the central axis 118 may demarcate a central, intermediate axis between the medial side 116 and the lateral side 114 of the article of footwear 100. Put differently, the central axis 118 may extend between a rear, proximal end 120 of the article of footwear 100 and a front, distal end 122 of the article of footwear 100 and may continuously define a middle of an insole 124, the sole structure 104, and/or the upper 102 of the article of footwear 100, i.e., the central axis 118 is a straight axis extending through the rear, proximal end 120 of the heel region 112 to the front, distal end 122 of the forefoot region 108.

Referring to FIG. 3, unless otherwise specified, the article of footwear 100 may be defined by the forefoot region 108, the midfoot region 110, and the heel region 112. The forefoot region 108 may generally correspond with portions of the article of footwear 100 that encase portions of a foot 126 that include a set of toes or phalanges 128, a ball of the foot 130, and a set of joints 132 that connect a set of metatarsals 134 of the foot 126 with the set of toes or phalanges 128. The midfoot region 110 is proximate and adjoins the forefoot region 108. The midfoot region 110 generally corresponds with portions of the article of footwear 100 that encase an arch 136 of the foot 126, along with a bridge 138 of the foot 126. The heel region 112 is proximate to the midfoot region 110 and adjoins the midfoot region 110. The heel region 112 generally corresponds with portions of the article of footwear 100 that encase rear portions of the foot 126, including a heel or calcaneus bone 140, an ankle (not shown), and/or an Achilles tendon (not shown).

Referring to FIGS. 1 and 2, the forefoot region 108, the midfoot region 110, the heel region 112, the medial side 116, and the lateral side 114 are intended to define boundaries or areas of the article of footwear 100. To that end, the forefoot region 108, the midfoot region 110, the heel region 112, the medial side 116, and the lateral side 114 generally characterize sections of the article of footwear 100. Certain aspects of the disclosure may refer to portions or elements that are coextensive with one or more of the forefoot region 108, the midfoot region 110, the heel region 112, the medial side 116, and/or the lateral side 114. Further, both the upper 102 and the sole structure 104 may be characterized as having portions within the forefoot region 108, the midfoot region 110, the heel region 112, and/or along the medial side 116 and/or the lateral side 114. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 116 and/or the lateral side 114.

Referring to FIGS. 2 and 3, the forefoot region 108, the midfoot region 110, the heel region 112, the medial side 116, and the lateral side 114 are shown in detail. The forefoot region 108 extends from a toe end 142 to a widest portion 144 of the article of footwear 100. The widest portion 144 is defined or measured along a first line 146 that is perpendicular with respect to the central axis 118 that extends from a distal portion of the toe end 142 to a distal portion of a heel end 148, which is opposite the toe end 142. The midfoot region 110 extends from the widest portion 144 to a thinnest portion 150 of the article of footwear 100. The thinnest portion 150 of the article of footwear 100 is defined as the thinnest portion of the article of footwear 100 measured across a second line 152 that is perpendicular with respect to the central axis 118. The heel region 112 extends from the thinnest portion 150 to the heel end 148 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 116, and/or the lateral side 114 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 116, and/or the lateral side 114 discussed herein.

Still referring to FIGS. 2 and 3, the medial side 116 begins at the distal, toe end 142 and bows outward along an inner side of the article of footwear 100 along the forefoot region 108 toward the midfoot region 110. The medial side 116 reaches the first line 146, at which point the medial side 116 bows inward, toward the central axis 118. The medial side 116 extends from the first line 146, i.e., the widest portion 144, toward the second line 152, i.e., the thinnest portion 150, at which point the medial side 116 enters into the midfoot region 110, i.e., upon crossing the first line 146. Once reaching the second line 152, the medial side 116 bows outward, away from the central axis 118, at which point the medial side 116 extends into the heel region 112, i.e., upon crossing the second line 152. The medial side 116 then bows outward and then inward toward the heel end 148, and terminates at a point where the medial side 116 meets the central axis 118.

The lateral side 114 also begins at the distal, toe end 142 and bows outward along an outer side of the article of footwear 100 along the forefoot region 108 toward the midfoot region 110. The lateral side 114 reaches the first line 146, at which point the lateral side 114 bows inward, toward the central axis 118. The lateral side 114 extends from the first line 146, i.e., the widest portion 144, toward the second line 152, i.e., the thinnest portion 150, at which point the lateral side 114 enters into the midfoot region 110, i.e., upon crossing the first line 146. Once reaching the second line 152, the lateral side 114 bows outward, away from the central axis 118, at which point the lateral side 114 extends into the heel region 112, i.e., upon crossing the second line 152. The lateral side 114 then bows outward and then inward toward the heel end 148 and terminates at a point where the lateral side 114 meets the central axis 118.

Referring to FIG. 2, the upper 102 extends along the lateral side 114 and the medial side 116, and across the forefoot region 108, the midfoot region 110, and the heel region 112 to house and enclose a foot of a user. When fully assembled, the upper 102 also includes an interior surface 154 and an exterior surface 156. The interior surface 154 faces inward and generally defines the interior cavity 106, and the exterior surface 156 of the upper 102 faces outward and generally defines an outer perimeter or boundary of the upper 102. The upper 102 also includes an opening 158 that is at least partially located in the heel region 112 of the article of footwear 100, which provides access to the interior cavity 106 and through which a foot may be inserted and removed. In some embodiments, the upper 102 may also include an instep region 160 that extends from the opening 158 in the heel region 112 over an area corresponding to an instep of a foot to an area proximate the forefoot region 108. The instep region 160 may comprise an area similar to where a tongue 162 of the present embodiment is disposed. In some embodiments, the upper 102 does not include the tongue 162, i.e., the upper 102 is tongueless.

Referring to FIG. 1, the sole structure 104 includes a midsole 164 and an outsole 166. The outsole 166 may define a bottom end or bottom surface 168 of the sole structure 104 across the heel region 112, the midfoot region 110, and the forefoot region 108. Further, the outsole 166 may be a ground-engaging portion or include a ground-engaging surface of the sole structure 104 and may be opposite of the insole thereof. As illustrated in FIG. 1, the bottom surface 168 of the outsole 166 may include a tread pattern 170 that can include a variety of shapes and configurations. The outsole 166 may be formed from one or more materials to impart durability, wear-resistance, abrasion resistance, or traction to the sole structure 104. In some embodiments, the outsole 166 may be formed from any kind of elastomer material, e.g., rubber, including thermoset elastomers or thermoplastic elastomers, or a thermoplastic material, e.g., thermoplastic polyurethane (TPU). In some embodiments, the outsole 166 may define a shore A hardness up to 95. In addition, the outsole 166 may be manufactured by a process involving injection molding, vulcanization, printing layer by layer, i.e., additive manufacturing systems or methods, and the like.

The midsole 164 may be individually constructed from a thermoplastic material, such as polyurethane (PU), for example, and/or an ethylene-vinyl acetate (EVA), copolymers thereof, or a similar type of material. In other embodiments, the midsole 164 may be an EVA-Solid-Sponge ("ESS") material, an EVA foam (e.g., PUMA® ProFoam Lite, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 164 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 164 is manufactured by a process involving injection molding, vulcanization, printing layer by layer, i.e., additive manufacturing systems or methods, and the like.

Referring to FIG. 1, in the embodiments where the midsole 164 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 164 may be formed using alternative methods known in the art, including the use of an expansion press, an injection machine, a pellet expansion process, a cold foaming process, a compression molding technique, die cutting, or any combination thereof. For example, the midsole 164 may be formed using a process that involves an initial foaming step in which supercritical gas is used to foam a material and then compression molded or die cut to a particular shape.

Figure 4:
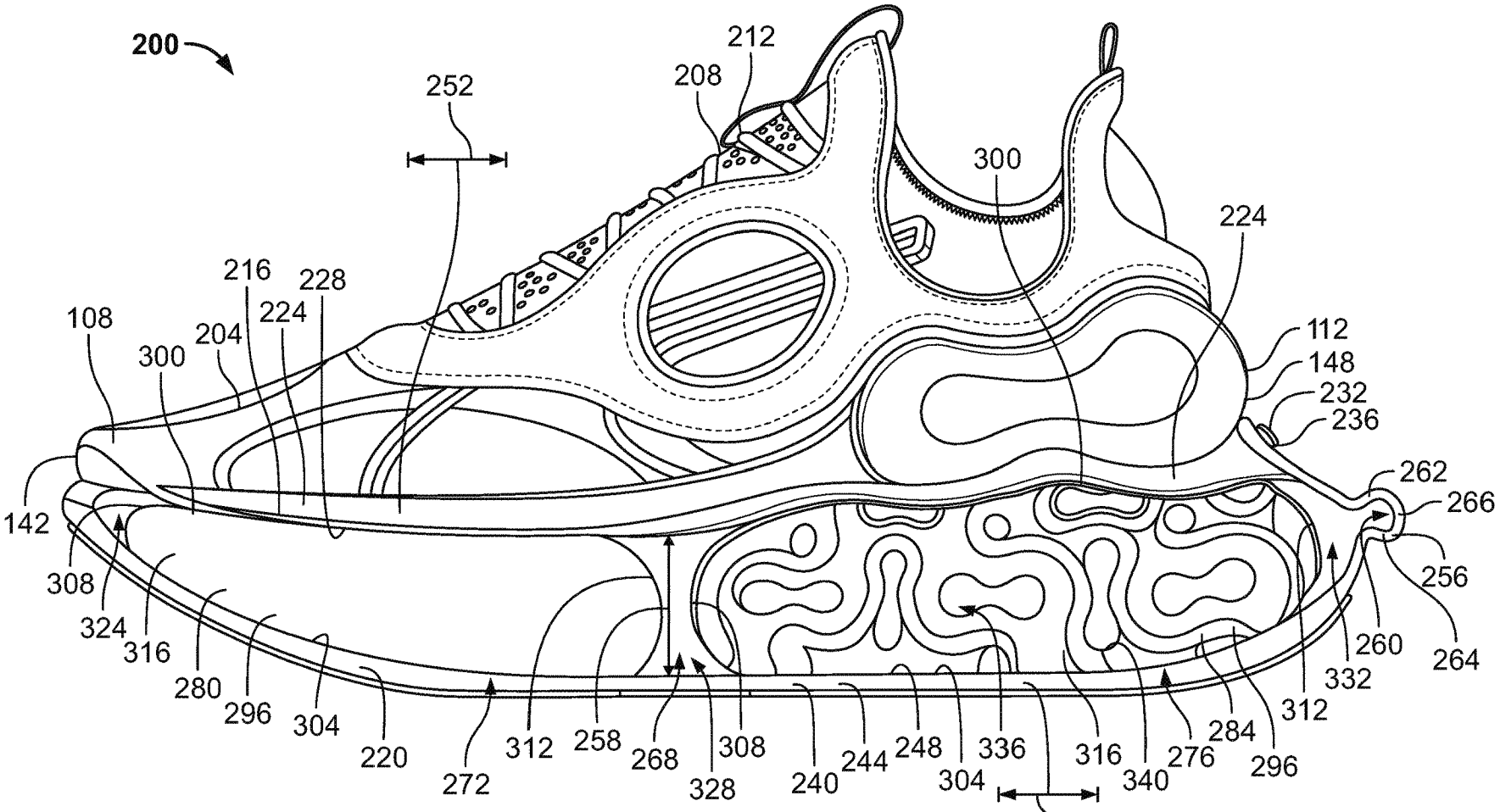
FIG. 4 is a schematic representation of a side view of a lateral side of an article of footwear configured as a left shoe with a first pod and a second pod shown, according to an embodiment of the present disclosure.

Referring to FIG. 4, another embodiment of an article of footwear 200 has an upper 204, a tongue 208, a set of laces 212, and a stabilizer 216 secured to the upper 204. The stabilizer 216 is secured to the upper 204 by welding, adhesive, sewing, overmolding, interference fit, or another technique as would be appreciated by those of ordinary skill in the art. The stabilizer 216 is secured to or integrally formed with an outsole 220 at the toe end 142 located in the forefoot region 108 and at the heel end 148 located in the heel region 112. In some embodiments, the stabilizer 216 can be secured to the outsole 220 by welding, adhesive, sewing, overmolding, or another technique as would be appreciated by those of ordinary skill in the art, such that the separation of the stabilizer 216 from the outsole 220 would require damaging either the stabilizer 216 or the outsole 220. The stabilizer 216 has a stabilizer body 224 having a lower surface 228.

In the illustrated embodiment of FIG. 4, the outsole 220 is integrally formed with the stabilizer 216 at the toe end 142 and is removably attached to the stabilizer 216 at the heel end 148 by an interference fit. The stabilizer 216 may have a first securing mechanism 232 that is configured to be secured to the heel end 148 of the outsole 220 by a first retention mechanism 236 (see FIG. 4). In FIG. 4, the first securing mechanism 232 is a tab, and the first retention mechanism 236 is an aperture. However, in other embodiments, the first retention mechanism 236 can be a hook, a clasp, or a snap fit configured cap, and the first securing mechanism 232 can be a hook, a clasp, or a retainer configured to retain a cap in an interference fit. The first retention mechanism 236 is configured to be selectively secured to the first securing mechanism 232. In one implementation, the first securing mechanism 232 is retained within the first retention mechanism 236 by an interference fit. The stabilizer 216, the outsole 220, or a combination of both, are sufficiently flexible to secure, connect, and retain the first retention mechanism 236 onto the first securing mechanism 232, as well as be sufficiently flexible to remove, replace, or disconnect the first retention mechanism 236 from the first securing mechanism 232.

It is contemplated that the stabilizer 216 and the outsole 220 may be attached to one another according to various configurations. For example, the first securing mechanism 232 may be provided on the outsole 220 and the first retention mechanism 236 may be provided on the stabilizer 216, such that a portion of the stabilizer 216 is received by the outsole 220 (not shown). Additionally or alternatively, the first securing mechanism 232 and first retention mechanism 236 may be provided at the toe end 142, or along other regions of the article of footwear 200. In some embodiments, the first securing mechanism 232 is retained within the first retention mechanism 236 by an interference fit, threading, latching, looping, or magnetic elements, among others. Still referring to FIG. 4, the outsole 220 includes an outsole body 240 that includes one segment 244 and an inner surface 248. The stabilizer 216 has a first length 252, as measured in a longitudinal direction parallel with the longitudinal axis L (see FIG. 1), and the outsole 220 has a second length 254 in the longitudinal direction. The first length 252 is shorter than the second length 254. In some embodiments, when the outsole 220 is secured to the stabilizer 216 at the toe end 142 and at the heel end 148, the outsole 220 has at least one nub 256. When the outsole 220 is secured to the stabilizer 216 at the toe end 142 and at the heel end 148, at least a portion of the inner surface 248 is spaced a first distance 258 or height measured perpendicularly from the lower surface 228 of the stabilizer 216. The first distance 258 may vary in height along the length and width of the lower surface 228. It will be appreciated that variation in the first distance 258 corresponds to a variation in adjustment of stack height, i.e., the distance between a user's foot in the article of footwear 200 and the ground.

The at least one nub 256 is a protrusion of the at least one segment 244 of the outsole body 240 that extends first toward the toe end 142 or the heel end 148 and then changes direction to extend toward the other of the toe end 142 or the heel end 148. The at least one nub 256 includes a semicircular or rounded, convexly curved projection of the outsole 220 that forms a suspension cavity 260 between an upper nub member 262 and a lower nub member 264 of the outsole 220. The upper nub member 262 and the lower nub member 264 are configured to flex with respect to a central nub member 266 that is located between the upper nub member 262 and the lower nub member 264. Further, the upper nub member 262 and the lower nub member 264 are configured to displace relative to one another during use, such that under compression the upper nub member 262 and the lower nub member 264 move toward a compressed state (not shown) by rotating with respect to the central nub member 266 and displacing, e.g., translating, vertically toward one another through the suspension cavity 260.

The upper nub member 262 and the lower nub member 264 of the illustrated embodiment of FIG. 4 may contact one another in the compressed state (not shown). When compression is removed, the upper nub member 262 and the lower nub member 264 may return to a rest state by, e.g., rotating with respect to the central nub member 266 of the at least one nub 256 and displacing, e.g., translating, away from one another, thereby expanding the at least one nub 256 and the suspension cavity 260 thereof (see FIG. 4). In the illustrated embodiment, the at least one nub 256 forms the rearmost point of article of footwear 200 and curves convexly between the upper nub member 262 and the lower nub member 264 of the outsole 220. Accordingly, the central nub member 266 is positioned at the rearmost point of the article of footwear 200, being spaced entirely rearwardly of the upper 204 proximate the heel end 148. In some embodiments, the central nub member 266 may be coextensive with the upper 204 at the heel end 148 of the article of footwear 200, or the central nub member 266 may be positioned forwardly of the upper 204 proximate the heel end 148. The first distance 258 is the length measured along the inner surface 248 of the outsole 220 that extends perpendicularly to the lower surface 228 of the stabilizer 216. That is, the outsole 220 is spaced apart from stabilizer 216 by the first distance 258. The first distance 258 may change along the length and width of the inner surface 248. The lower surface 228 of the stabilizer 216 and the inner surface 248 of the outsole 220 define a midsole cavity 268 between the stabilizer 216 and the outsole 220. The shape of the midsole cavity 268 is defined in part by the at least one nub 256 and the first distance 258.

Figure 5:
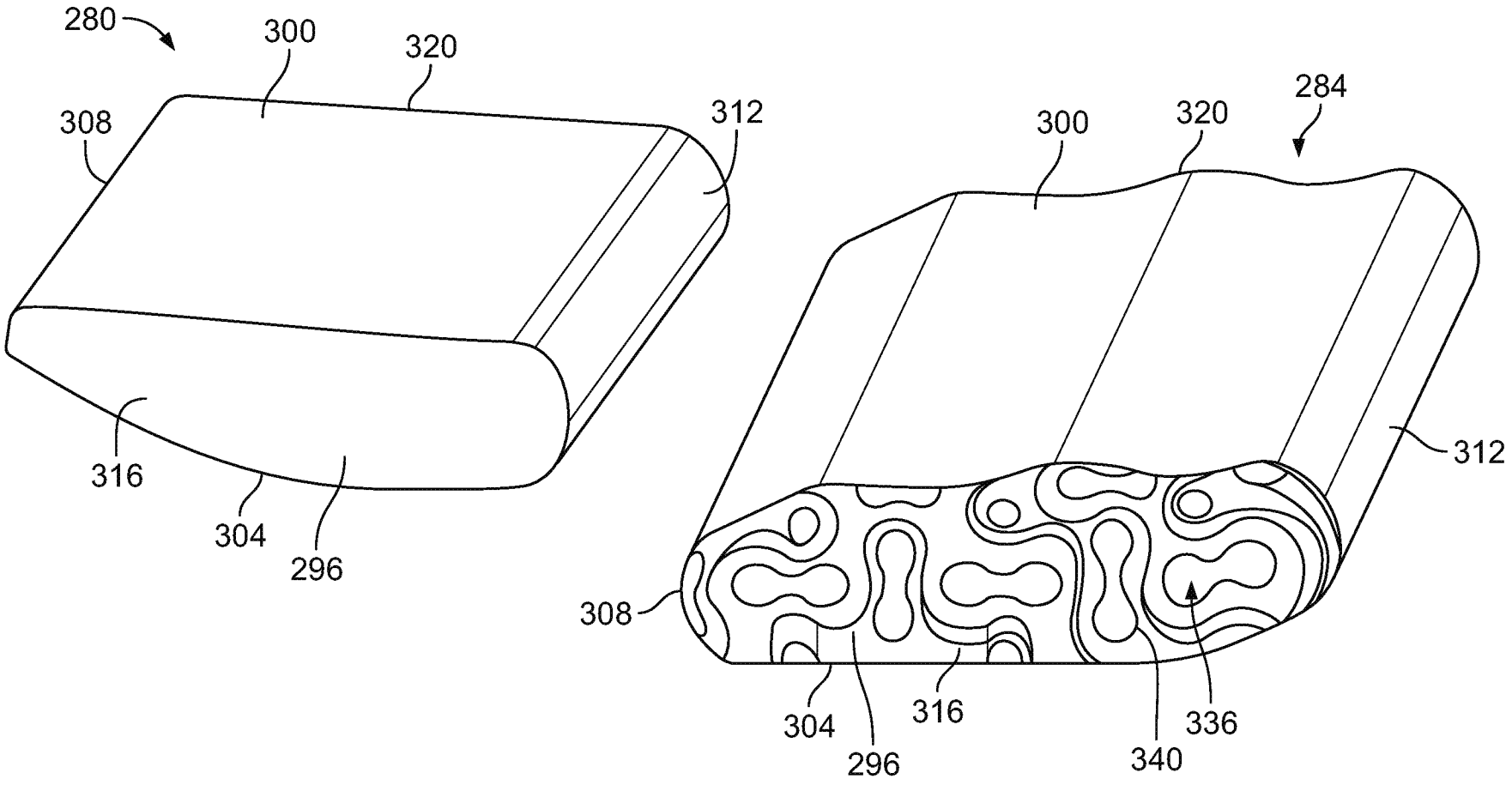
FIG. 5 is a schematic representation of a perspective view of the first pod and the second pod suitable for use with the article of footwear of FIG. 4.
Figure 6:
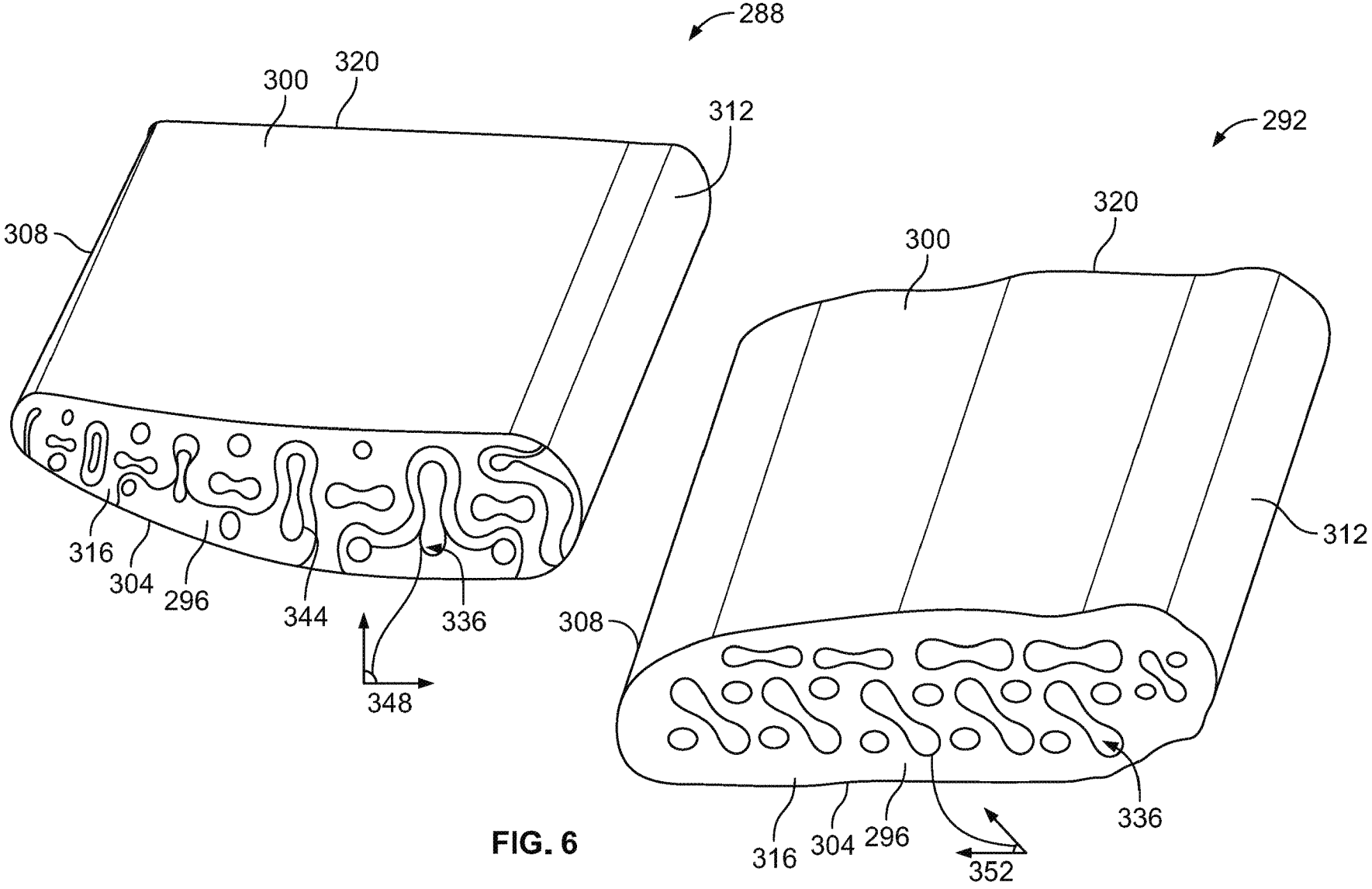
FIG. 6 is a schematic representation of a perspective view of a third pod and a fourth pod suitable for use with the article of footwear of FIG. 4.

Still referring to FIG. 4, the midsole cavity 268 defines a first or forward pod region 272 and a second or rear pod region 276. However, the midsole cavity 268 may be configured to have additional pod positions (not shown). A first pod 280 is configured to be received in either the forward pod region 272 or the rear pod region 276, and a second pod 284 is configured to be received in the forward pod region 272 or the rear pod region 276. In some embodiments, a third pod 288 (see FIG. 6) is configured to be received in either the forward pod region 272 or the rear pod region 276, and a fourth pod 292 (see FIG. 6) is configured to be received in the forward pod region 272 or the rear pod region 276. That is, each of the first pod 280, the second pod 284, the third pod 288, and the fourth pod 292 may be interchangeable between the forward pod region 272 and the rear pod region 276. Referring to FIGS. 4-6, the first pod 280, the second pod 284, the third pod 288, or the fourth pod 292 are configured to be received in the forward pod region 272, the rear pod region 276, or both. For instance, the forward pod region 272 and the rear pod region 276 could both be occupied by one of the first pods 280. The first pod 280, the second pod 284, the third pod 288, and the fourth pod 292 are configured to be replaceable or exchangeable within the midsole cavity 268. However, in some embodiments, more than four different pods 280, 284, 288, 292 may be available. It will be understood that the pod regions 272, 276 may be referenced herein as pod positions, either collectively or individually.

Referring to FIGS. 4-6, each of the pods 280, 284, 288, 292 has a pod body 296 with a top surface 300, a bottom surface 304, a front surface 308, a rear surface 312, a lateral surface 316, and a medial surface 320 (see FIGS. 5 and 6). In some embodiments or arrangements, the top surface 300 is configured to contact the lower surface 228 of the stabilizer 216, and the bottom surface 304 is configured to contact the inner surface 248 of the outsole 220. In some embodiments or arrangements, the top surface 300 may contact the inner surface 248 of the outsole 220 and the bottom surface 304 may contact the lower surface 228 of the stabilizer 216. In some embodiments, when the respective pod 280, 284, 288, 292 is received in the forward pod region 272 or the rear pod region 276, the respective pod 280, 284, 288, 292 is secured to the lower surface 228 of the stabilizer 216 by welding or applying adhesive to the top surface 300 of the respective pod 280, 284, 288, 292. When the respective pod 280, 284, 288, 292 is received in the forward pod region 272 or the rear pod region 276, the respective pod 280, 284, 288, 292 may be secured to the inner surface 248 of the outsole 220 by welding or applying adhesive to the bottom surface 304 of the respective pod 280, 284, 288, 292.

The respective pods 280, 284, 288, 292 can be removed or severed after being secured by welding or adhesives, by cutting or prying (not shown) the pod body 296 from the inner surface 248 or the lower surface 228. This can be facilitated by releasing the first securing mechanism 232 from the first retention mechanism 236 and rotating the outsole 220 away from the stabilizer 216. Then the pod body 296 can be removed. A new pod 280, 284, 288, 292 can be secured to the lower surface 228 or the inner surface 248, or switched between the forward pod region 272 and the rear pod region 276. The outsole 220 can then be rotated toward the stabilizer 216, and the first securing mechanism 232 can be secured to the first retention mechanism 236. The various pods 280, 284, 288, 292 then contact both the lower surface 228 and the inner surface 248. In this way, the replacement, exchange, or removal of the various pods 280, 284, 288, 292 can be accomplished without having to discard the entire article of footwear 200.

Referring to FIGS. 4-6, each of the pods 280, 284, 288, 292 can have different characteristic amounts of stiffness, resilience, deformation, rigidity, and medial or lateral support. The pods 280, 284, 288, 292 may serve as a way to provide cushioning to the article of footwear 200, similar to the cushioning provided by the midsole 164 of the exemplary article of footwear 100. For example, the pods 280, 284, 288, 292 may be exchanged, replaced, or removed to modify the amount of stiffness, the resilience, the deformation, and the overall rigidity or cushioning effect of the article of footwear 200 that a user experiences when taking a footstep. For example, the size of the pods 280, 284, 288, 292 may be adjustable. The pods 280, 284, 288, 292 may be expanded or retracted, or replaced or relocated, to increase or decrease the first distance 258 of the article of footwear 200, which corresponds to a change in stack height, i.e., a distance between the user's foot in the article of footwear 200 and the ground. In some embodiments, the pods 280, 284, 288, 292 may account for different biomechanics of the user. The pods 280, 284, 288, 292 may be arranged and customized. In some embodiments, the user can adjust the stiffness or height in the forefoot region 108 or heel region 112 of the sole structure 104. The pods 280, 284, 288, 292 may expand to accommodate a larger article of footwear 200.

Figure 7:
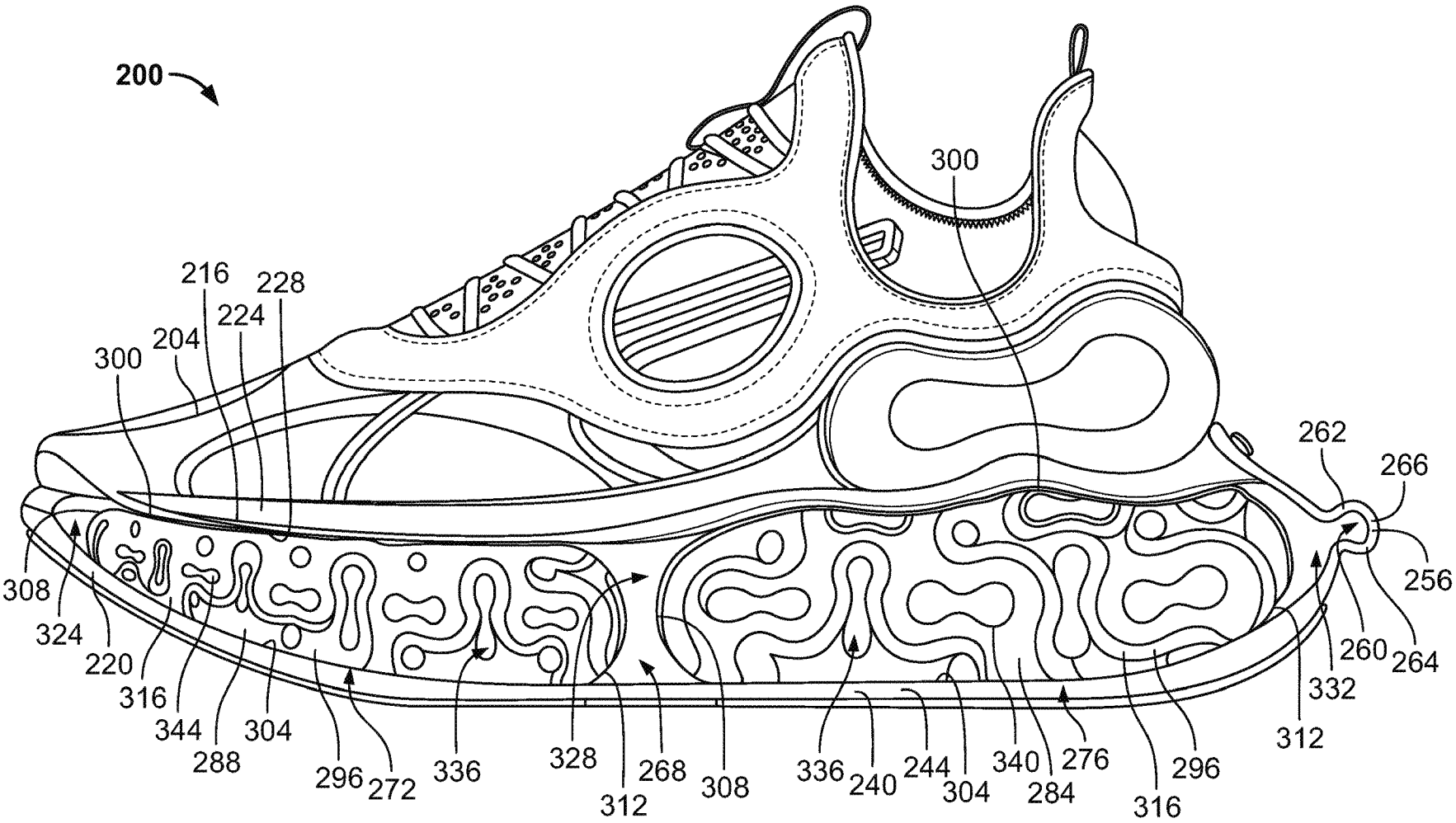
FIG. 7 is a schematic representation of the side view of the article of footwear of FIG. 4, with the third pod and the second pod shown.

In the illustrated embodiments of FIGS. 4 and 7, the midsole cavity 268 defines a toe end cavity 324 positioned between the lower surface 228 of the stabilizer 216, the inner surface 248 of the outsole 220, and the forward pod region 272. The front surface 308 of the pod 280, 284, 288, 292 that is received in the forward pod region 272 faces the toe end cavity 324. In some embodiments, the midsole cavity 268 defines a midfoot cavity 328 positioned between the lower surface 228 of the stabilizer 216, the inner surface 248 of the outsole 220, the forward pod region 272, and the rear pod region 276. The front surface 308 of the pod 280, 284, 288, 292 that is received in the rear pod region 276 and the rear surface 312 of the pod 280, 284, 288, 292 that is received in the forward pod region 272 face the midfoot cavity 328. In some embodiments, the midsole cavity 268 defines a heel end cavity 332 positioned between the lower surface 228 of the stabilizer 216, the inner surface 248 of the outsole 220, and the rear pod region 276. The rear surface 312 of the pod 280, 284, 288, 292 that is received in the rear pod region 276 faces the heel end cavity 332. In some embodiments, the at least one nub 256 defines a part of the boundary of the heel end cavity 332 or the toe end cavity 324. When the at least one nub 256 defines a part of the boundary of the heel end cavity 332 or the toe end cavity 324, the suspension cavity 260 is a portion of the volume of space that forms the corresponding heel end cavity 332 or the toe end cavity 324. In some embodiments, the pods 280, 284, 288, 292 may be concealed or embedded in the sole structure 104.

In the illustrated embodiments of FIGS. 5 and 6, one or more of the pod bodies 296 is made of the same material as the midsole 164 of the exemplary article of footwear 100 illustrated in FIGS. 1-3. In some embodiments, one or more of the respective pod bodies 296 of the respective pods 280, 284, 288, 292 is made of a different material than another of the respective pods 280, 284, 288, 292. In some embodiments, at least one of the respective pod bodies 296 of the respective pods 280, 284, 288, 292 includes an auxetic material. A discussion of auxetic material and its characteristics are described and disclosed in application 62/923,909, filed on Oct. 21, 2019, now published as U.S. Patent Pub. No. 2021/0112917A1 on Apr. 22, 2021, and is incorporated by reference in its entirety herein. Auxetic material is characterized in part by material that exhibits a negative Poisson's ratio and may be configured to be programmably deformable. The respective pod bodies 296 that include auxetic material define a plurality of cavities or voids 336. The plurality of voids 336 define in part the programmable deformation that can be produced by the respective pod bodies 296.

Two characteristics of the plurality of voids 336 include the size of each of the plurality of voids 336, and the orientation of each of the plurality of voids 336. When the respective pod body 296 has a first size 340 for each of the plurality of voids 336, such as the second pod 284, which is different than a second size 344 for the plurality of voids 336 of a different respective pod body 296, such as the third pod 288, the cushioning effect or the programmable deformation of the two respective pods 284, 288 may be different. Referring to FIG. 6, when the respective pod body 296 has a first orientation 348 for each of the plurality of voids 336, such as the third pod 288, which is different than a second orientation 352 for the plurality of voids 336 of a different respective pod body 296, such as the fourth pod 292, the cushioning effect or the programmable deformation of the two respective pods 288, 292 may be different.

Referring generally to FIGS. 4-7, the differences in the programmable deformation or cushioning effect between the various pods 280, 284, 288, 292 can be applied to the article of footwear 200 by exchanging, swapping out, or replacing one of the pods 280, 284, 288, 292 for another pod 280, 284, 288, 292. In addition, by having space within the midsole cavity 268 so that different sized pods 280, 284, 288, 292 can be inserted into the forward pod region 272 and the rear pod region 276, the outsole 220 may be able to accommodate different sizes of pods 280, 284, 288, 292 within the same midsole cavity 268. For instance, the article of footwear 200 of FIG. 4 may be configured to accommodate a size 9, 10 or 11 men's-sized article of footwear 200 while using the same outsole 220. The different sized pods 280, 284, 288, 292 would lead to larger or smaller toe end cavities 324, larger or smaller midfoot cavities 328, larger or smaller heel end cavities 332, and larger or smaller nubs 256 for the midsole cavity 268. This versatility in accommodating different sizes of the article of footwear 200 in turn may lead to a smaller amount of inventory in the outsoles 220 and, in certain circumstances, the pods 280, 284, 288, 292.

In some embodiments, the article of footwear 200 has the upper 204, the sole structure 104 or the outsole 220, the first pod 280, the second pod 284, and the third pod 288. The outsole 220 is removably attached to the upper 204 at one of the heel end 148 or the toe end 142. The first pod 280 may be configured to be received between the outsole 220 and the upper 204 within the forefoot region 108. The second pod 284 may be configured to be received between the upper 204 and the outsole 220 within the heel region 112. The third pod 288 may be configured to be exchanged with the first pod 280 or the second pod 284. In some aspects, a method of exchanging pods 280, 284, 288, 292 in an article of footwear 200 includes providing an upper 102 attached to a stabilizer 216 that has a lower surface 228 and a first securing mechanism 232. The method further includes providing an outsole 220 that is pivotably secured to the stabilizer 216 and has a first retention mechanism 236 and an interior surface 154. In addition, the method comprises providing a first pod 280 and a second pod 284. In some embodiments, the method includes releasing the first retention mechanism 236 from the first securing mechanism 232 and pivoting the outsole 220 away from the stabilizer 216. In some embodiment, the method includes securing the first pod 280 and the second pod 284 to the outsole 220 or the stabilizer 216. In some embodiments, the method includes securing the first pod 280 or the second pod 284 using adhesive or welding. In some embodiments, the method includes rotating the outsole 220 toward the stabilizer 216 and securing the first securing mechanism 232 to the first retention mechanism 236. In some embodiments, the method includes securing the first pod 280 or the second pod 284 to the outsole 220 or the stabilizer 216, providing a third pod 288 different from the first pod 280 and the second pod 284, and replacing the first pod 280 or the second pod 284 with the third pod 288. In some embodiments, the first pod 280 has a characteristic that is different than a characteristic of the second pod 284, which is different than a characteristic of the third pod 288. For instance, the characteristic of the first pod 280 may be a first stiffness, and the characteristic of the second pod 284 may be a second stiffness, wherein the first stiffness is less rigid than the second stiffness. The characteristic of the first pod 280 may be that the first pod 280 is made of a foam material, and the characteristic of the second pod 284 may be that the second pod 284 is made of an auxetic material that defines the plurality of voids 336 that have a programmable deformation.

Still generally referring to FIGS. 4-7, when the wearer of the article of footwear 200 is leaning forward, the pod 280, 284, 288, 292 in the forward pod region 272 provides more support than when the wearer of the article of footwear 200 is in an upright or neutral position. When the wearer of the article of footwear 200 is leaning rearward, such as, e.g., where the heel end 148 of the article of footwear 200 first contacts the ground during a footstep, the pod 280, 284, 288, 292 in the rear pod region 276 provides more support than when the wearer of the article of footwear 200 is in an upright or neutral position. As the respective pods 280, 284, 288, 292 can be allocated to the forward pod region 272 or the rear pod region 276 as desired, assuming that the respective pod 280, 284, 288, 292 is configured to be received in both pod positions 272, 276, the article of footwear 200 can be configured to adapt to a variety of different desired programmable deformation configurations. For instance, if a shoe manufacturer of the article of footwear 200 desires to provide an article of footwear 200 that is configured and optimized for playing tennis, and another article of footwear 200 that is configured and optimized for running marathons, by simply replacing one or both of the pods 280, 284, 288, 292 with another of the pods 280, 284, 288, 292, a different programmable deformation or cushioning effect can be achieved. The cushioning effect of the article of footwear 200 is configured to be adjusted by exchanging the first pod 280 for one of the second pod 284 or the third pod 288. When the first pod 280 is provided in the forward pod region 272 and the second pod 284 is provided in the rear pod region 276 a cushioning effect associated with a rear pod region 276 of the article of footwear 200 is configured to be adjusted by exchanging the first pod 280 with the second pod 284. In some embodiments, the pod arrangement achieves a new cushioning effect. As used herein, cushioning effect refers to characteristics of resilience, dampening, energy return, flexibility, propulsion, and stiffness.

Figure 8:
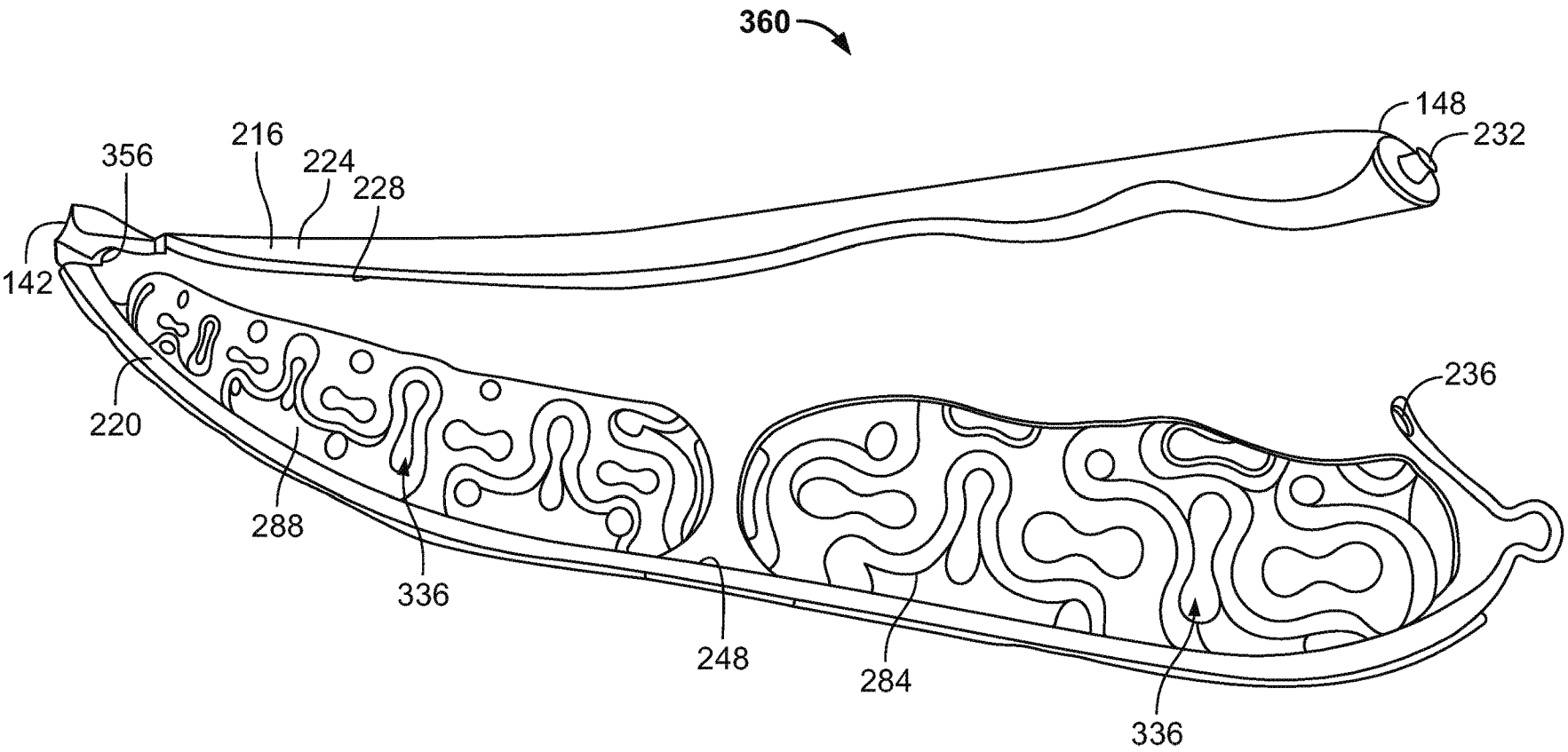
FIG. 8 is a schematic representation of a side view of the article of footwear of FIG. 4, with an outsole and a stabilizer that is disconnected from a tab or retention mechanism of the stabilizer, and with an upper hidden from view.

Referring to FIG. 8, the article of footwear 200 illustrated has the outsole 220 and the stabilizer 216 integrally formed or secured together at the toe end 142, and the first retention mechanism 236 is disconnected from the first securing mechanism 232 at the heel end 148. In this embodiment, the first securing mechanism 232 is on the stabilizer 216 and the first retention mechanism 236 is on the outsole 220. The outsole 220 can pivot about a toe axis 356 located at the toe end 142 of the stabilizer 216. The third pod 288 and the second pod 284 are shown secured to the inner surface 248 of the outsole 220 and disconnected or unsecured to the lower surface 228 of the stabilizer 216. In some embodiments, the pods 280, 284, 288, 292 are disconnected from the lower surface 228 of the stabilizer 216 by removing the adhesive, or by severing the welded material (not shown) of the respective pods 280, 284, 288, 292 from the lower surface 228, forming an open configuration 360. In the open configuration 360, the at least one of the respective pods 280, 284, 288, 292 can be removed, replaced or exchanged by severing the pod 280, 284, 288, 292 from the inner surface 248 of the outsole 220, or the at least one of the respective pods 280, 284, 288, 292 can be prepared to be reattached or reconnected to the lower surface 228 of the stabilizer 216. When desired, the first securing mechanism 232 is reattached or reconnected to the first retention mechanism 236. In this way, the respective pods 280, 284, 288, 292 can be replaced or exchanged without discarding the entire article of footwear 200.

Figure 9:
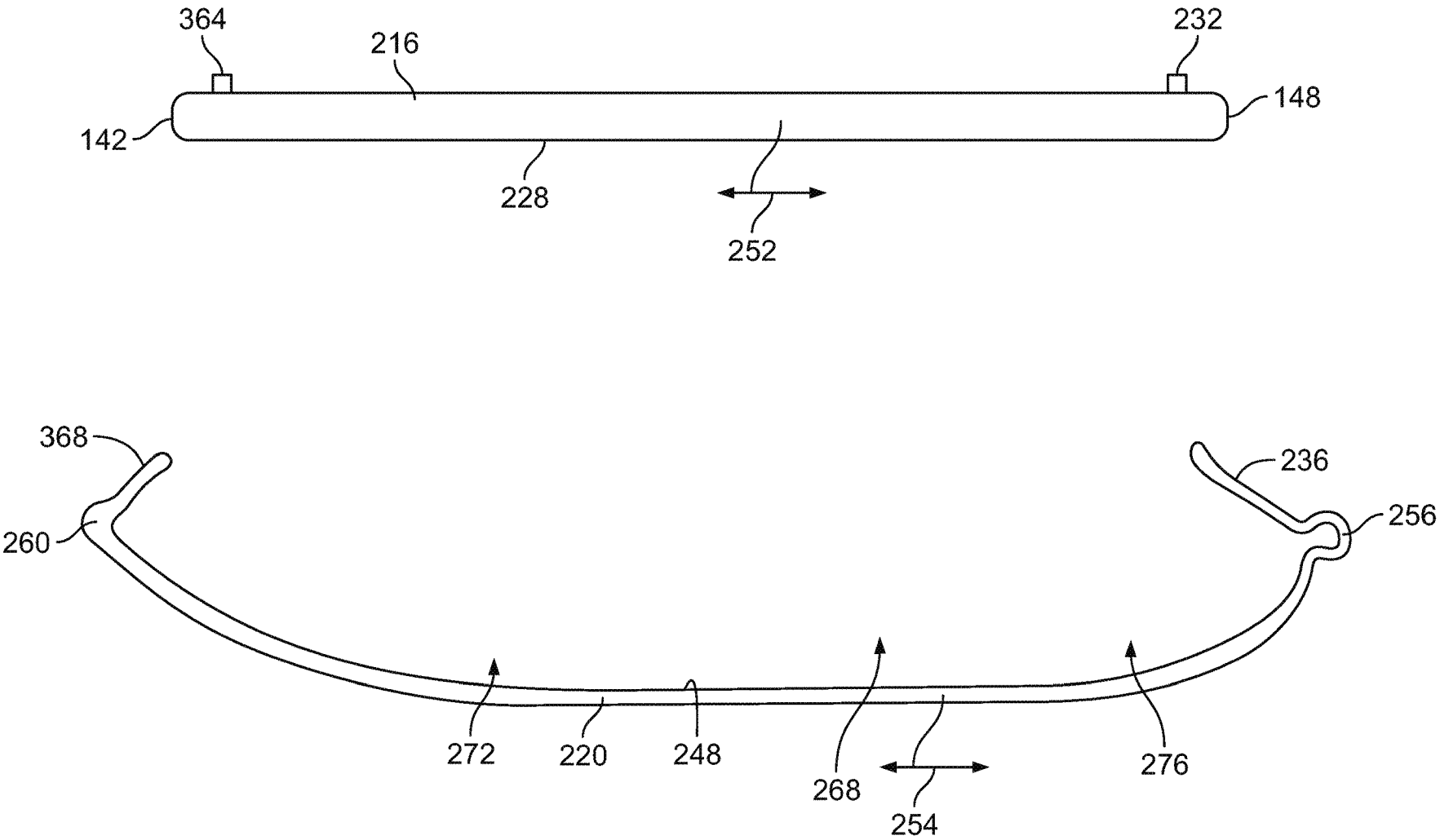
FIG. 9 is a schematic representation of a side view of another embodiment of a stabilizer and an outsole.

Referring to FIG. 9, a different embodiment of the stabilizer 216 and the outsole 220 is illustrated with the stabilizer 216 having the first securing mechanism 232 at the heel end 148 and a second securing mechanism 364 at the toe end 142. The outsole 220 has the first retention mechanism 236 at the heel end 148 and a second retention mechanism 368 at the toe end 142. The first securing mechanism 232 is configured to be secured to the first retention mechanism 236 at the heel end 148, and the second securing mechanism 364 is configured to be secured to the second retention mechanism 368 at the toe end 142. The outsole 220 has the at least one nub 256 and the suspension cavity 260, which facilitate movement of the first securing mechanism 232 and the second securing mechanism 364 when selectively securing to the first retention mechanism 236 and the second retention mechanism 368, respectively. The second length 254 of the outsole 220 is longer than the first length 252 of the stabilizer 216 so that the midsole cavity 268 formed between the stabilizer 216 and the outsole 220 can accommodate both the forward pod region 272 and the rear pod region 276. In some embodiments, the first retention mechanism 236 (see FIG. 8), the second retention mechanism 368, or both are positioned on the outsole 220. In some embodiments, the first securing mechanism 232, (see FIG. 8) the second retention mechanism 368, or both are positioned on the stabilizer 216. In the illustrated embodiment of FIG. 9, the pods 280, 284, 288, 292 are secured to the inner surface 248 of the outsole 220 and the lower surface 228 of the stabilizer 216 may be removed, replaced, or exchanged without discarding the outsole 220, the stabilizer 216, or the upper 204. In addition, since the outsole 220 is not connected to the stabilizer 216, the outsole 220 may also be discarded and replaced while keeping the upper 204 and the stabilizer 216.

Figure 10:
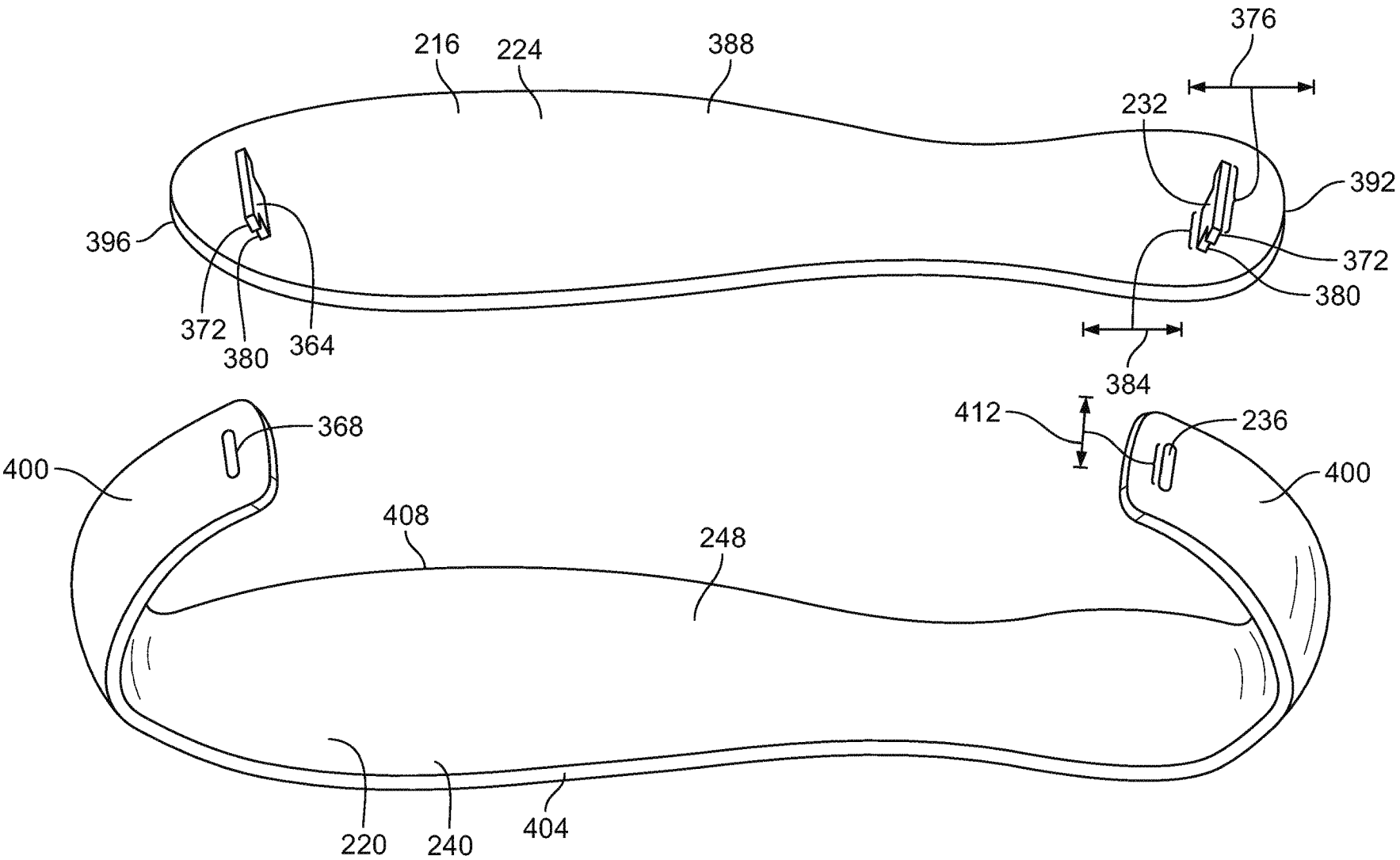
FIG. 10 is a schematic representation of a perspective view of the stabilizer and the outsole of FIG. 9.
Figure 11:
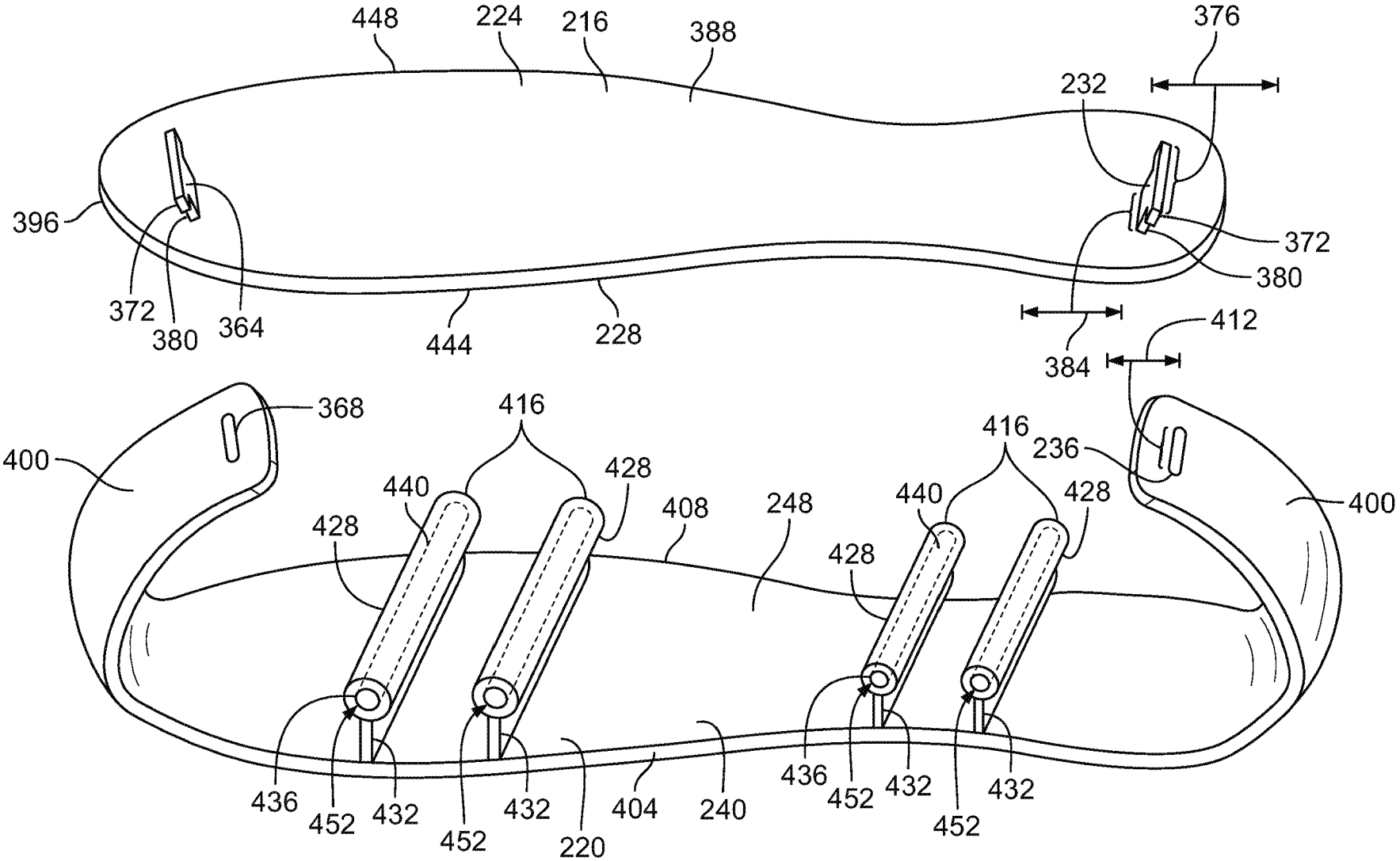
FIG. 11 is a schematic representation of a perspective view of the stabilizer and the outsole of FIG. 9 with a plurality of ribs.
Figure 12:
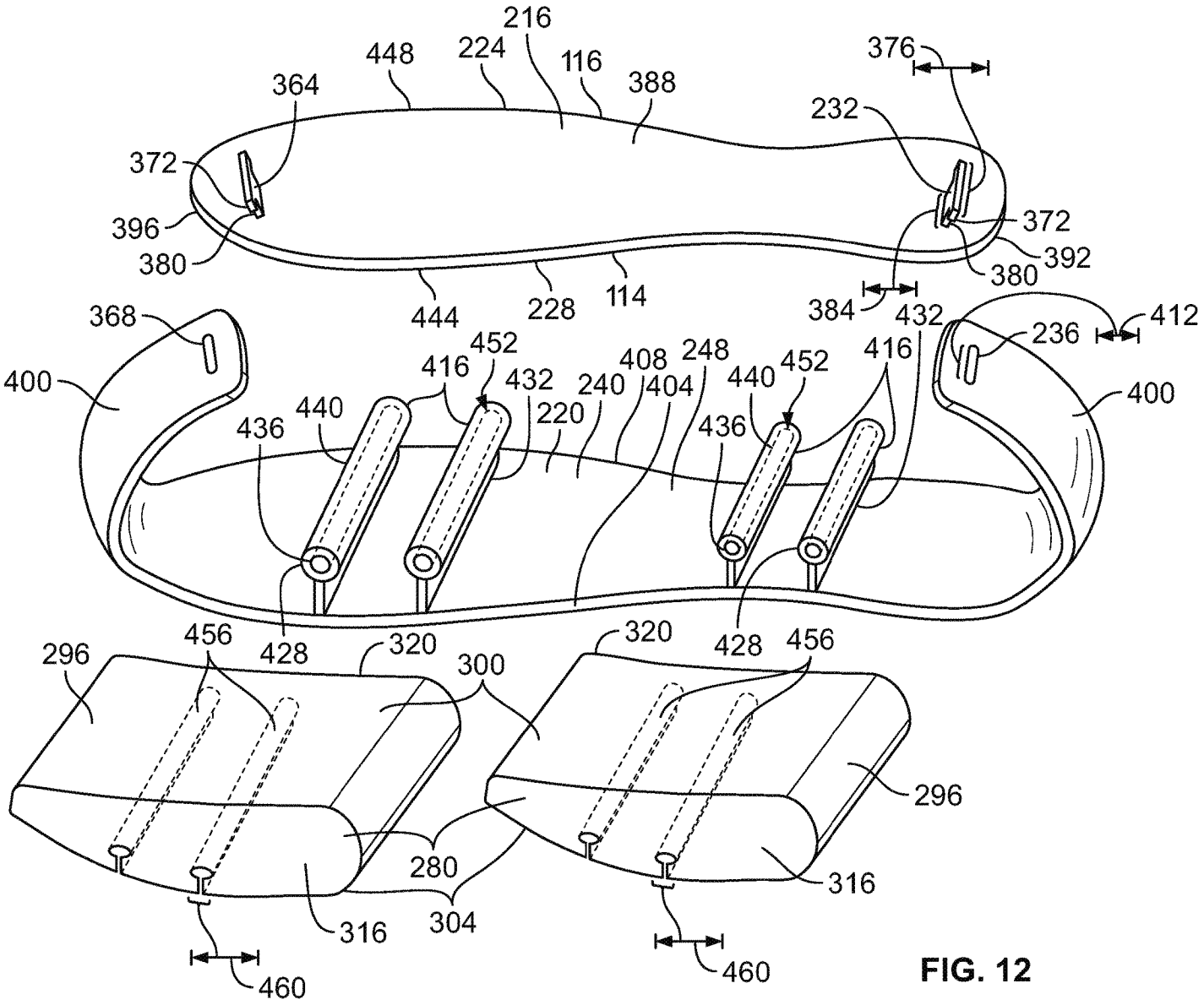
FIG. 12 is a schematic representation of a perspective view of the stabilizer and the outsole of FIG. 11, with two of the pods having at least one groove shown.

Referring to FIGS. 10-12, the first securing mechanism 232 and the second securing mechanism 364 each have a securing flange 372 with a securing flange width 376. The securing flange 372 extends from a securing base 380 that defines a securing base width 384. In the illustrated embodiment, the first retention mechanism 236 and the second retention mechanism 368 may be oriented at an angle to the toe end 142 or the heel end 148, which may enhance the retention of the first retention mechanism 236 and the second retention mechanism 368. The securing base 380 extends from an upper surface 388 of the stabilizer body 224. The first securing mechanism 232 is positioned adjacent to a rear end 392 and the second securing mechanism 364 is positioned adjacent to a forward end 396. When coupled or assembled together, the rear end 392 and the forward end 396 of the stabilizer 216 are positioned on opposite ends of the outsole body 240. In some embodiments, the first retention mechanism 236 and the second retention mechanism 368 are oval or slot-shaped and extend from the inner surface 248 of the outsole 220 to an exterior surface 400 of the outsole 220. The outsole 220 has a first sidewall 404 opposite a second sidewall 408, and the widest diameter of the oval or slot shaped first retention mechanism 236 and the second retention mechanism 368 forms a retention mechanism width 412. The securing flange width 376 is wider than the securing base width 384, which is wider than the retention mechanism width 412. In other embodiments, the securing base width 384 and the retention mechanism width 412 may be the same width, or the securing base width 384 may be narrower than the retention mechanism width 412.

In the illustrated embodiments of FIGS. 11 and 12, the outsole body 240 includes a plurality of ribs 416 that extend from the first sidewall 404 to the second sidewall 408 of the outsole 220 along the inner surface 248. Each of the plurality of ribs 416 includes a distal end 428 and a proximate end 432. The distal end 428 is wider than the proximate end 432. In the illustrated embodiment the distal end 428 and the proximate end 432 extend from the first sidewall 404 to the second sidewall 408. The distal end 428 has a central aperture 436, which defines an internal surface 440. The internal surface 440 further defines an internal cavity 452 that extends through the distal end 428, which increases the flexibility of the distal end 428. In some embodiments, the distal end 428 does not have the central aperture 436. The proximate end 432 connects the distal end 428 to the inner surface 248 of the outsole body 240. The proximate end 432 is configured to be sufficiently flexible to bend in relation to the inner surface 248.

In the illustrated embodiment of FIGS. 11 and 12, the stabilizer 216 has a lateral edge 444 and a medial edge 448, and in some embodiments, the plurality of ribs 416 extend from the lateral edge 444 to the medial edge 448 of the stabilizer 216 toward the outsole 220. However, in some embodiments, the plurality of ribs 416 may not extend to the lateral edge 444, the medial edge 448, or both. When the plurality of ribs 416 extend from the stabilizer 216, the proximate end 432 connects the distal end 428 to the lower surface 228 of the stabilizer body 224, and the proximate end 432 is configured to be flexible enough to bend in relation to the lower surface 228.

Referring to FIG. 12, the pod body 296 of at least one of the pods 280, 284, 288, 292 is configured to have an at least one groove 456 having a groove width 460 that is configured to retain at least one of the plurality of ribs 416. The groove width 460 is the widest distance of the at least one groove 456 along the lateral surface 316 of the pod body 296. The at least one groove 456 extends from the lateral surface 316 to the medial surface 320 of the pod body 296. The at least one groove 456 extends through either the top surface 300 or the bottom surface 304 of the pod body 296. In some embodiments, the pod 280, 284, 288, 292 with the at least one groove 456 is configured to slide onto the plurality of ribs 416 so that the pod 280, 284, 288, 292 is retained to the outsole 220 or the stabilizer 216. The at least one groove 456 of the pod body 296 may be secured to the plurality of ribs 416 of the stabilizer 216 or the outsole 220, or both, by welding, or by adhesive. In the illustrated embodiment, the lateral edge 444 of the stabilizer 216 and the first sidewall 404 of the outsole 220 is aligned with the lateral surface 316 of the pod 280, 284, 288, 292 when the medial edge 448 of the stabilizer 216 and the second sidewall 408 of the outsole 220 is aligned with the medial surface 320 of the pod 280, 284, 288, 292. In some embodiments, at least one of the sidewalls 404, 408 or edges 444, 448 of the stabilizer 216 and the outsole 220 for each of the pods 280, 284, 288, 292 may be configured to fit within and be recessed inwardly, with respect to the lateral side 114 and the medial side 116 of the article of footwear 200. The pods 280, 284, 288, 292 may be secured to the stabilizer 216 (see FIG. 13) and the outsole 220 by the plurality of ribs 416 being retained by the corresponding grooves 456 of the pod 280, 284, 288, 292, in addition to securing the top surface 300 and the bottom surface 304 of the pod body 296 by adhesive or by welding.

Figure 13:
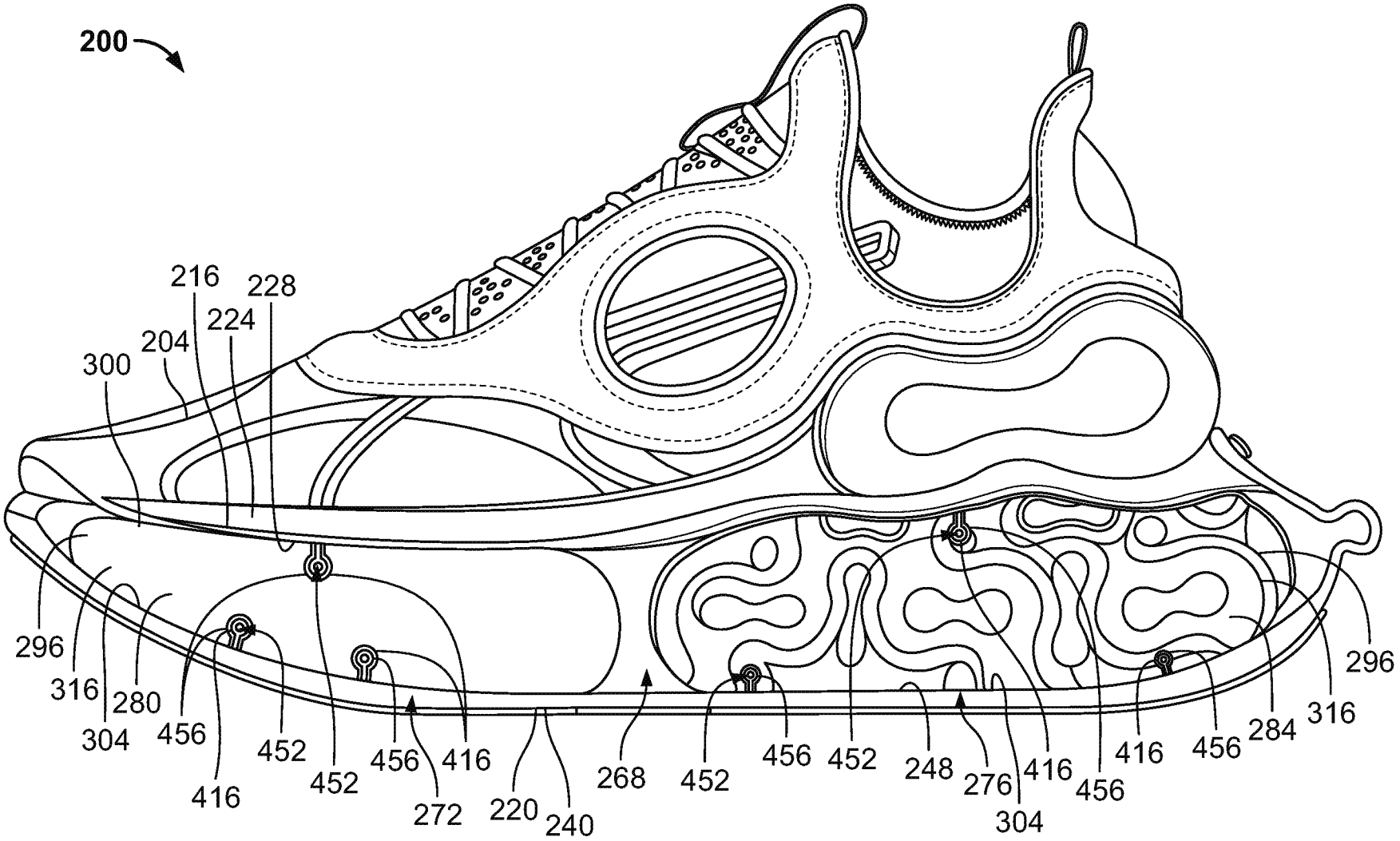
FIG. 13 is a schematic representation of the side view of the article of footwear of FIG. 4 being configured with the first pod and the second pod each with at least one groove secured by a plurality of ribs, according to an embodiment of the present disclosure.

Referring to FIG. 13, the article of footwear 200 in the illustrated embodiment has the first pod 280 in the forward pod region 272 and the second pod 284 in the rear pod region 276. Two of the plurality of ribs 416 extend from the lower surface 228 of the stabilizer 216 to insert into the respective grooves 456 in the top surface 300 of the first pod 280 and the second pod 284. The outsole 220 has four of the plurality of ribs 416 that extend from the inner surface 248 of the outsole 220 to insert into the respective grooves 456 in the bottom surface 304 of the first pod 280 and the second pod 284. In the illustrated embodiment the first pod 280 and the second pod 284 are secured to the inner surface 248 of the outsole 220 and the lower surface 228 of the stabilizer 216 by adhesive or welding. Adhesives or welding may be utilized to secure the plurality of ribs 416 to the corresponding grooves 456. The internal cavity 452 of each of the plurality of ribs 416 extends from the lateral side 114 to the medial side 116 of the article of footwear 200.

Figure 14:
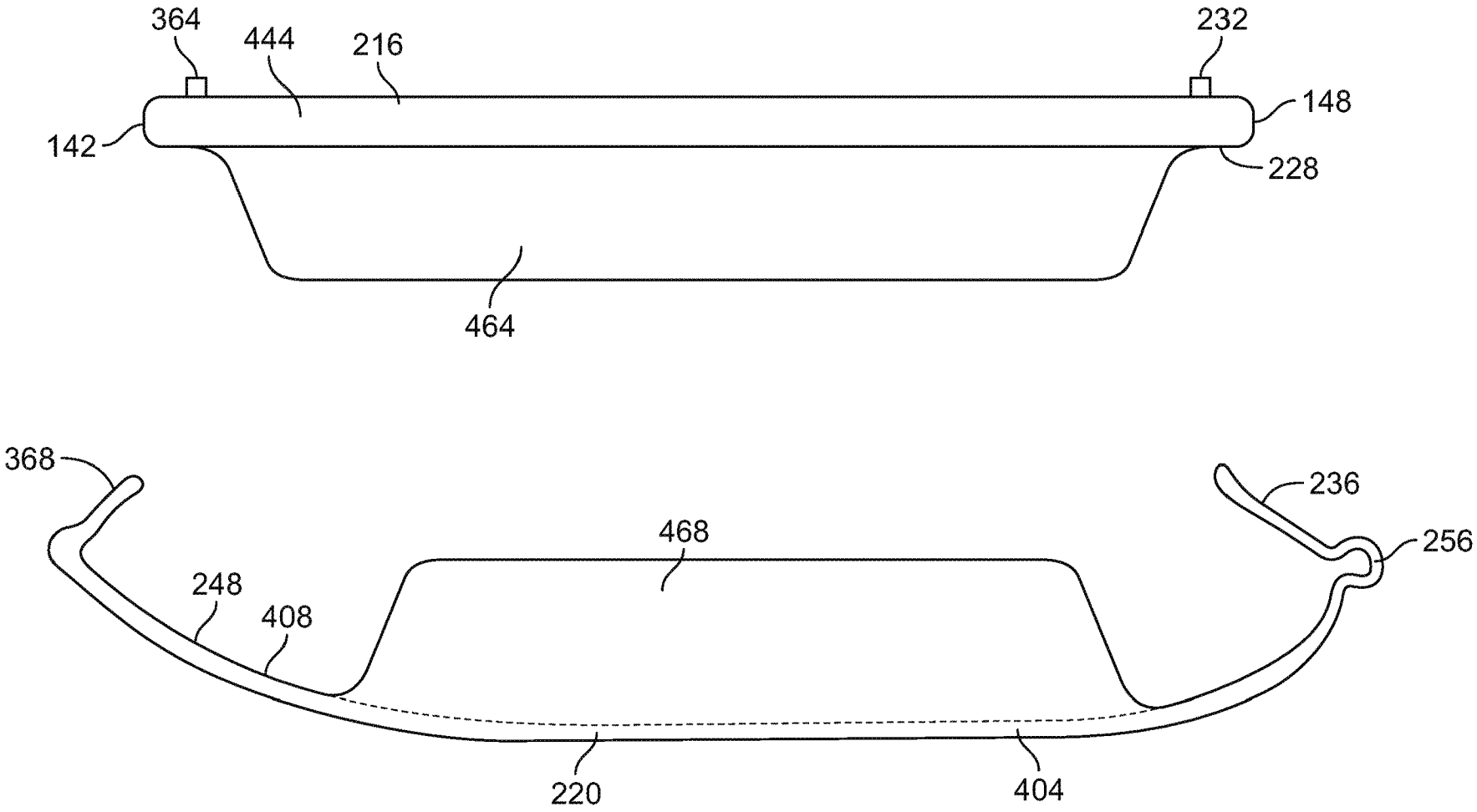
FIG. 14 is a schematic representation of a side view of a stabilizer and an outsole that are each configured with a peripheral lip.

Referring to the illustrated embodiment of FIG. 14, the stabilizer 216 includes a first peripheral lip 464 that projects downwardly from the lower surface 228 along the lateral edge 444, and the outsole 220 includes a second peripheral lip 468 that projects upwardly from the inner surface 248 along the second sidewall 408. The first peripheral lip 464 is formed integrally with the stabilizer 216 and may be configured to be relatively more rigid, less rigid, or have the same degree of rigidity as the stabilizer 216. The second peripheral lip 468 is formed integrally with the outsole 220 and may be configured to be relatively more rigid, less rigid, or have the same degree of rigidity as the outsole 220. The first peripheral lip 464 and the second peripheral lip 468 are configured to provide a barrier to the pods 280, 284, 288, 292 from shifting laterally once secured to the outsole 220 or the stabilizer 216. In some embodiments, the stabilizer 216 may have the first peripheral lip 464 positioned on the medial edge 448 rather than the lateral edge 444, or may have the first peripheral lip 464 extending from both the lateral edge 444 and the medial edge 448. In some embodiments, the outsole 220 may have the second peripheral lip 468 positioned on the first sidewall 404 rather than the second sidewall 408, or may have the second peripheral lip 468 extending from both the first sidewall 404 and the second sidewall 408. The first peripheral lip 464 and/or the second peripheral lip 468 are illustrated as extending substantially from the toe end 142 to the heel end 148, but the first peripheral lip 464 and the second peripheral lip 468 may extend less than the entire length of the stabilizer 216 or the outsole 220. In addition, the first peripheral lip 464 and/or second peripheral lip 468 may be configured to extend toward but not contact either the stabilizer 216 or the outsole 220. Alternatively, the first peripheral lip 464 and/or second peripheral lip 468 may be configured to contact either the stabilizer 216 or the outsole 220. The height or shape of the first peripheral lip 464 and/or second peripheral lip 468 may be configured to be flat, wavy, jagged, undulating, or curved.

Figure 15:
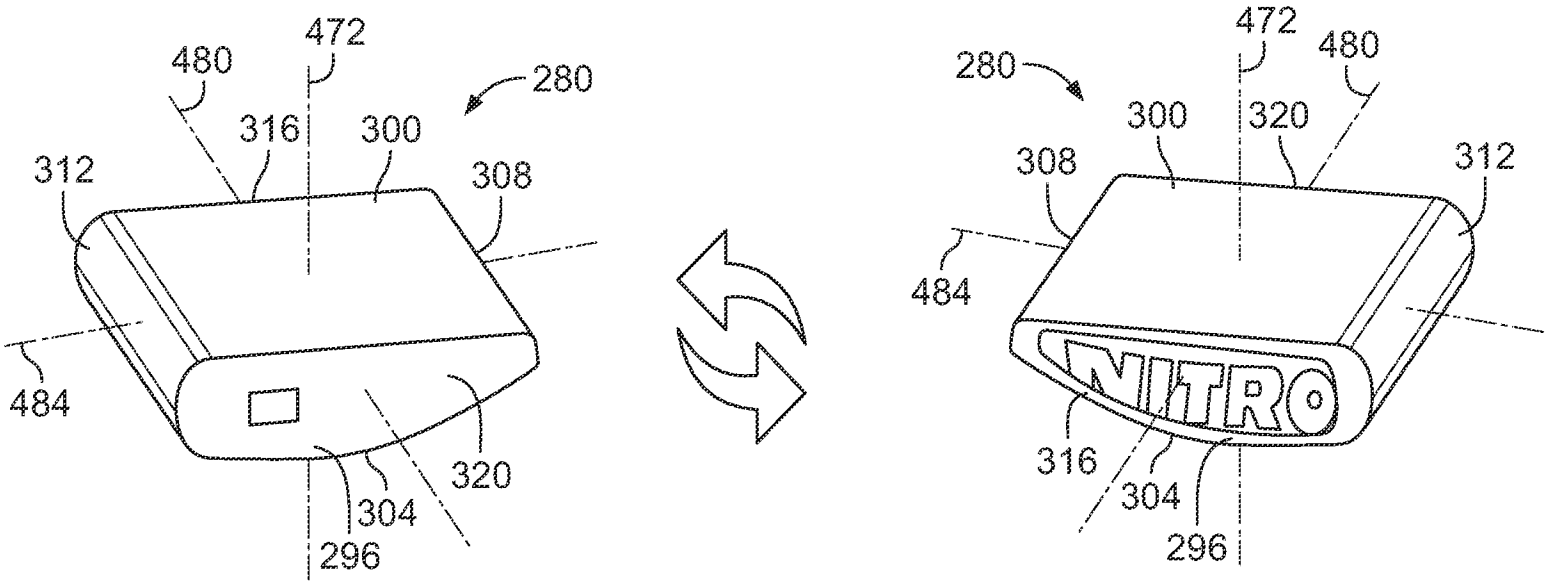
FIG. 15 is a schematic representation of another embodiment of the pods.

Referring to FIGS. 5, 6, and 15, the pods 280, 284, 288, 292 are configured to be installed in the article of footwear 200 in different orientations. Each of the pods 280, 284, 288, 292 defines a first central axis or Z axis 472 that extends through a centroid, i.e., geometric center, of the pod body 296 to intersect the top surface 300 and the bottom surface 304. Further, each of the pods 280, 284, 288, 292 defines a second central axis or X axis 844 that extends through the centroid of the pod body 296 to intersect the front surface 308 and the rear surface 312. The X axis 484 is disposed orthogonal to the Z axis. Further, each of the pods 280, 284, 288, 292 defines a third central axis or Y axis 480 that extends through the centroid to intersect the lateral surface 316 and the medial surface 320. The Y axis 480 is disposed orthogonal to the X axis 484 and the Z axis 472. Each of the pods 280, 284, 288, 292 can be rotated about its respective Z axis 472, the X axis 484, or the Y axis 480, or combinations thereof. In the illustrated embodiments, the pods 280, 284, 288, 292 are asymmetrical about one or more of the Z axis 472, the X axis 484, or the Y axis 480, such that reorientation by rotation adjusts a distribution of mass, functional properties or characteristics, shape, size, and appearance. In some embodiments, re-orientation of the pods 280, 284, 288, 292 can adjust the first distance 258 and, thus, can adjust the stack height of the article of footwear 200. For instance, re-orientation of the pods 280, 284, 288, 292 can adjust the first distance 258 in one or more directions (e.g., in a lateral-to-medial direction or in a toe-to-heel direction). Further, re-orientation of the pods 280, 284, 288, 292 can be performed to display different designs or colors, provide support or stiffness in different areas, or accommodate for different biomechanics, or combinations thereof. Altering the pods 280, 284, 288, 292 orientations can allow a user to use the same pods 280, 284, 288, 292 in different types of articles of footwear 200 and articles of footwear 200 of different sizes. In some embodiments, the pods 280, 284, 288, 292 can be exposed in the sole structure 104 to reveal a design or logo. In some aspects, the pods 280, 284, 288, 292 can be rotated to show different design elements on either the lateral surface 316, the medial surface 320, the top surface 300, the bottom surface 304, the front surface 308, or the rear surface 312.

In some embodiments, one or more of the pods 280, 284, 288, 292 includes a power storage (not shown), such as, e.g., a battery, a capacitor, a piezoelectric transducer, or any suitable energy source that can be directly or indirectly coupled with a socket or electrical contact (not shown) in the article of footwear 200, such as in the outsole 220 or stabilizer 216. It is contemplated that the article of footwear 200 may include an electrical circuit (not shown) embedded or attached thereto and operably coupled with the power source (see FIG. 15) of the pods 280, 284, 288, 292 for providing a variety of functions, such as, e.g., visual communication or display, audio communication or playback, measurement or detection based on data collection via sensors, wireless communication, authentication, power storage or energy harvesting, cushioning effects, or combinations thereof. It is further contemplated that any of the pods 280, 284, 288, 292 may include other components of the electrical circuit (not shown), such as a display unit, a speaker unit, communication unit, a sensor or a transducer, an authentication unit, or combinations thereof. It is contemplated that the authentication unit can include an electronic tag, e.g., an NFC or RFID tag, or machine readable code, or uniquely arranged magnetic elements, or combinations thereof. In still further embodiments, the one or more of the pods 280, 284, 288, 292 or article of footwear 200 may include different electronic features, such as the electronic features in shoes described in U.S. patent application Ser. No. 18/218,539, filed on Jul. 5, 2023, U.S. patent application Ser. No. 18/227,009, filed on Jul. 27, 2023, and U.S. patent application Ser. No. 18/228,114, filed on Jul. 31, 2023.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear, comprising:

an upper attached to a stabilizer having a lower surface, the stabilizer extending from a toe end to a heel end;

a tab extending from the heel end of the stabilizer;

an outsole having an aperture and an interior surface;

a first pod that is a foam body that includes a first top surface opposite a first bottom surface, wherein the first pod directly contacts the lower surface and the interior surface, the first pod defining a plurality of voids disposed along a lateral surface of the first pod, wherein the plurality of voids is exposed along the lateral surface; and a second pod that includes a second top surface opposite a second bottom surface, wherein the second top surface only directly contacts the lower surface of the stabilizer and the second bottom surface only directly contacts the interior surface of the outsole, the second pod disposed in a forefoot region of the article of footwear, wherein the tab is configured to be retained within the aperture at the heel end and the stabilizer is integrally formed with the outsole at the toe end, wherein a volume between the lower surface and the interior surface forms a midsole cavity, and wherein the midsole cavity is configured to receive the first pod and the second pod.

2. The article of footwear of claim 1, wherein the first top surface only directly contacts the lower surface of the stabilizer, and the first bottom surface only directly contacts the interior surface of the outsole.

3. The article of footwear of claim 2, wherein the first pod is secured to the lower surface or the interior surface.

4. The article of footwear of claim 3, wherein the first pod is secured by an adhesive or by welding.

5. The article of footwear of claim 1, wherein the aperture is configured to be selectively retained by the tab.

6. The article of footwear of claim 1, wherein the outsole is configured to rotate with respect to the stabilizer when the aperture is not retained by the tab.

7. The article of footwear of claim 1, wherein at least one of the second top surface or the second bottom surface of the second pod includes at least one groove, wherein the at least one groove is configured to be secured to at least one rib of at least one of the lower surface of the stabilizer or the interior surface of the outsole.

8. An article of footwear, comprising:

an upper attached to a stabilizer having a lower surface, the stabilizer extending from a toe end to a heel end;

a tab extending from the heel end of the stabilizer;

an outsole having an aperture and an interior surface;

a first pod that is a foam body that includes a top surface opposite a bottom surface, wherein the top surface only directly contacts the lower surface of the stabilizer and the bottom surface only directly contacts the interior surface of the outsole, the first pod defining a plurality of voids disposed along a lateral surface of the first pod, wherein the plurality of voids is exposed along the lateral surface; and a second pod that directly contacts the lower surface and the interior surface, wherein the aperture is configured to receive the tab at the heel end and the stabilizer is integrally formed with the outsole at the toe end, wherein a volume between the lower surface and the interior surface forms a midsole cavity that includes a forward pod region, wherein the forward pod region is configured to receive the first pod, and wherein the first pod is configured to be exchanged with the second pod in the forward pod region.

9. The article of footwear of claim 8, wherein the midsole cavity further comprises a rear pod region that is configured to receive one of the first pod and second pod.

10. The article of footwear of claim 9, wherein, when the tab is retained within the aperture, one of the first pod or second pod is retained in the midsole cavity.

11. The article of footwear of claim 10, further comprising a third pod, and wherein the third pod is configured to be exchanged with the first pod or the second pod.

12. The article of footwear of claim 11, wherein the first pod has a first stiffness, the second pod has a second stiffness greater than the first stiffness, and the third pod has a third stiffness greater than the second stiffness.

13. The article of footwear of claim 12, wherein a first cushioning effect of the article of footwear is configured to be adjusted by exchanging the first pod for one of the second pod or the third pod.

14. The article of footwear of claim 12, wherein, when the first pod is provided in the forward pod region and the second pod is provided in the rear pod region a second cushioning effect associated with the rear pod region of the article of footwear is configured to be adjusted by exchanging the first pod with the second pod.

15. The article of footwear of claim 8, wherein at least one of the top surface or the bottom surface of the first pod includes at least one groove, wherein the at least one groove is configured to be secured to at least one corresponding rib of at least one of the lower surface of the stabilizer or the interior surface of the outsole.

16. A method of exchanging pods in an article of footwear, comprising:

providing an upper attached to a stabilizer having a lower surface, the stabilizer extending from a toe end to a heel end, and a tab extending from the heel end of the stabilizer;

providing an outsole pivotably secured to the stabilizer and having an aperture and an interior surface, wherein the stabilizer is integrally formed with the outsole at the toe end;

providing a first pod that is a foam body that defines a plurality of voids disposed along a lateral surface of the first pod, wherein the plurality of voids is exposed along the lateral surface;

providing a second pod in a forefoot region, the second pod having a top surface opposite a bottom surface;

directly contacting the first pod with the interior surface and the lower surface;

directly contacting the top surface of the second pod with the lower surface and the bottom surface of the second pod with the interior surface, wherein the top surface of the second pod only contacts the lower surface and the bottom surface of the second pod only contacts the interior surface; and securing the tab within the aperture at the heel end.

17. The method of claim 16 further comprising releasing the aperture from the tab and pivoting the outsole away from the stabilizer.

18. The method of claim 17 further comprising securing the first pod and the second pod to the outsole or the stabilizer.

19. The method of claim 18 further comprising securing the first pod or the second pod using an adhesive or welding.

20. The method of claim 19 further comprising rotating the outsole toward the stabilizer and securing the tab within the aperture.

21. The method of claim 16 further comprising securing the first pod or the second pod to the outsole or the stabilizer, providing a third pod different from the first pod and the second pod, and replacing the first pod or the second pod with the third pod.

22. The method of claim 16 further comprising securing at least one groove of at least one of the top surface or the bottom surface of the second pod to at least one corresponding rib of at least one of the lower surface of the stabilizer or the interior surface of the outsole.

* * * * *